US008142969B2

(12) United States Patent
Ezumi et al.

(10) Patent No.: US 8,142,969 B2
(45) Date of Patent: Mar. 27, 2012

(54) ELECTROPHOTOGRAPHIC PHOTORECEPTOR, PROCESS CARTRIDGE AND IMAGE FORMING APPARATUS

(75) Inventors: Tetsuya Ezumi, Kanagawa (JP); Masayuki Nishikawa, Kanagawa (JP); Daisuke Haruyama, Kanagawa (JP); Hirofumi Nakamura, Kanagawa (JP); Kazuyuki Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 966 days.

(21) Appl. No.: 12/076,912

(22) Filed: Mar. 25, 2008

(65) Prior Publication Data

US 2008/0273897 A1 Nov. 6, 2008

(30) Foreign Application Priority Data

May 2, 2007 (JP) ..... 2007-121682

(51) Int. Cl.
*G03G 5/147* (2006.01)

(52) U.S. Cl. ..... 430/66; 430/60; 430/69

(58) Field of Classification Search ..... 430/60, 430/66, 69

See application file for complete search history.

(56) References Cited

U.S. PATENT DOCUMENTS

| | | | | |
|---|---|---|---|---|
| 5,162,182 | A * | 11/1992 | Maruta | |
| 6,399,262 | B1 | 6/2002 | Oshiba et al. | |
| 6,531,253 | B2 * | 3/2003 | Ehara et al. | 430/66 |
| 2005/0037274 | A1 * | 2/2005 | Shida et al. | 430/60 |

FOREIGN PATENT DOCUMENTS

| | | | |
|---|---|---|---|
| JP | A-61-149962 | * | 7/1986 |
| JP | A-61-238060 | | 10/1986 |
| JP | A-03-168751 | * | 7/1991 |
| JP | A-04-170554 | * | 6/1992 |
| JP | A-06-138685 | * | 5/1994 |
| JP | A-07-013379 | * | 1/1995 |
| JP | A-8-76388 | | 3/1996 |
| JP | A-2000-112159 | * | 4/2000 |
| JP | A-2000-171991 | * | 6/2000 |
| JP | A-2000-284514 | | 10/2000 |
| JP | A-2002-082469 | * | 3/2002 |
| JP | A-2002-303995 | * | 10/2002 |
| JP | A-2003-186234 | * | 7/2003 |
| JP | A-2005-301244 | | 10/2005 |
| JP | A-2006-10921 | | 1/2006 |

OTHER PUBLICATIONS

Oct. 11, 2011 Office Action issued is Japanese Patent Application No. 2007-121682 (with translation).

* cited by examiner

*Primary Examiner* — Christopher Rodee
*Assistant Examiner* — Jonathan Jelsma
(74) *Attorney, Agent, or Firm* — Oliff & Berridge, PLC

(57) ABSTRACT

An electrophotographic photoreceptor includes a conductive support; a photosensitive layer; and a surface protective layer as an outermost layer of the electrophotographic photoreceptor, wherein the electrophotographic photoreceptor satisfies following formulas (a) and (b):

$$3.6 \leqq (A+B)/C \times 100 \leqq 6 \quad \text{(a)}$$

$$B \leqq 0.3 \quad \text{(b)}$$

wherein A (μm) represents a ten-point-averaged surface roughness $R_{ZJIS94}$ of the conductive support, B (μm) represents a ten-point-averaged surface roughness $R_{ZJIS94}$ of the surface protective layer, and C (%) represents a reflectivity of the surface protective layer against the conductive support.

11 Claims, 6 Drawing Sheets

ELECTROPHOTOGRAPHIC PHOTORECEPTOR, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2007-121682 filed on May 2, 2007.

BACKGROUND

1. Technical Field

The present invention relates to an electrophotographic photoreceptor which is usable as an electrostatic latent image carrier of an electrophotographic image forming apparatus, and a process cartridge and an image forming apparatus using the same.

2. Related Art

Recently, organic photosensitive materials having photosensitive layer made of organic photoconductive materials, which are advantageous in being less expensive and excellent in availability and dispersal, have been mainly employed as electrophotographic photoreceptors (hereinafter sometimes called "photoreceptors") employed in electrophotographic devices such as copying machines and laser bean printers as a substitute for inorganic photoreceptors using inorganic photoconductive materials such as selenium, selenium-tellurium alloys, selenium-arsenic alloys and cadmium sulfide. In particular, functional separated organic laminated photoreceptors including a charge generating layer, which generates charge upon exposure, and a charge transporting layer, which transports the thus generated charge, laminated thereon are excellent in the electrophotographic properties.

SUMMARY

According to an aspect of the invention, there is provided an electrophotographic photoreceptor including a conductive support; a photosensitive layer; and a surface protective layer as an outermost layer of the electrophotographic photoreceptor, wherein the electrophotographic photoreceptor satisfies following formulas (a) and (b):

$$3.6 \leqq (A+B)/C \times 100 \leqq 6 \quad \text{(a)}$$

$$B \leqq 0.3 \quad \text{(b)}$$

wherein A (μm) represents a ten-point-averaged surface roughness $R_{ZJIS94}$ of the conductive support, B (μm) represents a ten-point-averaged surface roughness $R_{ZJIS94}$ of the surface protective layer, and C (%) represents a reflectivity of the surface protective layer against the conductive support.

BRIEF DESCRIPTION OF THE DRAWINGS

Exemplary embodiment(s) of the present invention will be described in detail based on the following figures, wherein.

DETAILED DESCRIPTION

Next, exemplary embodiments of the invention will be described in detail.

In drawings, the same symbol is assigned to members of the same function and repeated description thereof is omitted.

[Electrophotographic Photoreceptor]

<Layer Constitution>

The electrophotographic photoreceptor according to the invention includes at least a photosensitive layer formed on the surface of a conductive support and a surface protective layer formed as the outermost layer. Concerning the photosensitive layer, there can be enumerated a constitution wherein the photosensitive layer includes a charge generating layer and a charge transporting layer that are functionally separated and another constitution wherein a layer including both of a charge generating material and a charge transporting material and thus functions as a charge generating layer as well as a charge transporting layer (hereinafter referred to as "a single layer type photosensitive layer").

Figure 1:
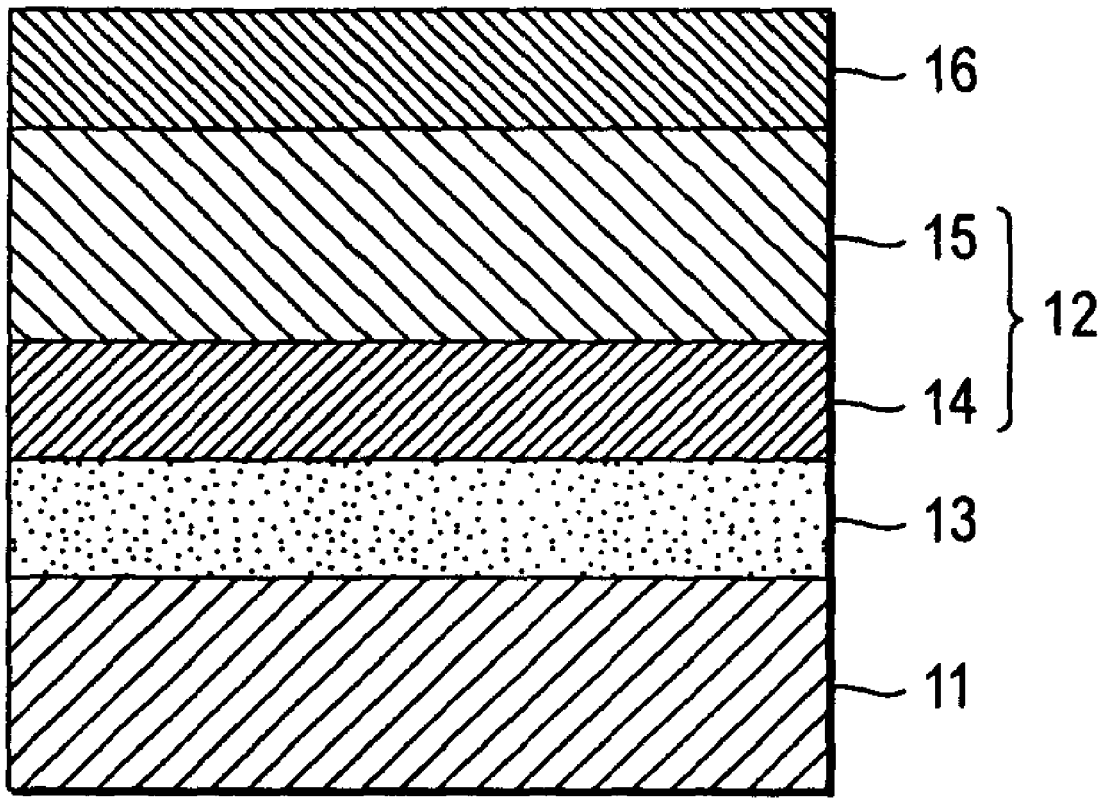
FIG. 1 is a typical enlarged sectional view showing an exemplary embodiment of the layer constitution of the electrophotographic photoreceptor according to an aspect of the innovation.
Figure 2:
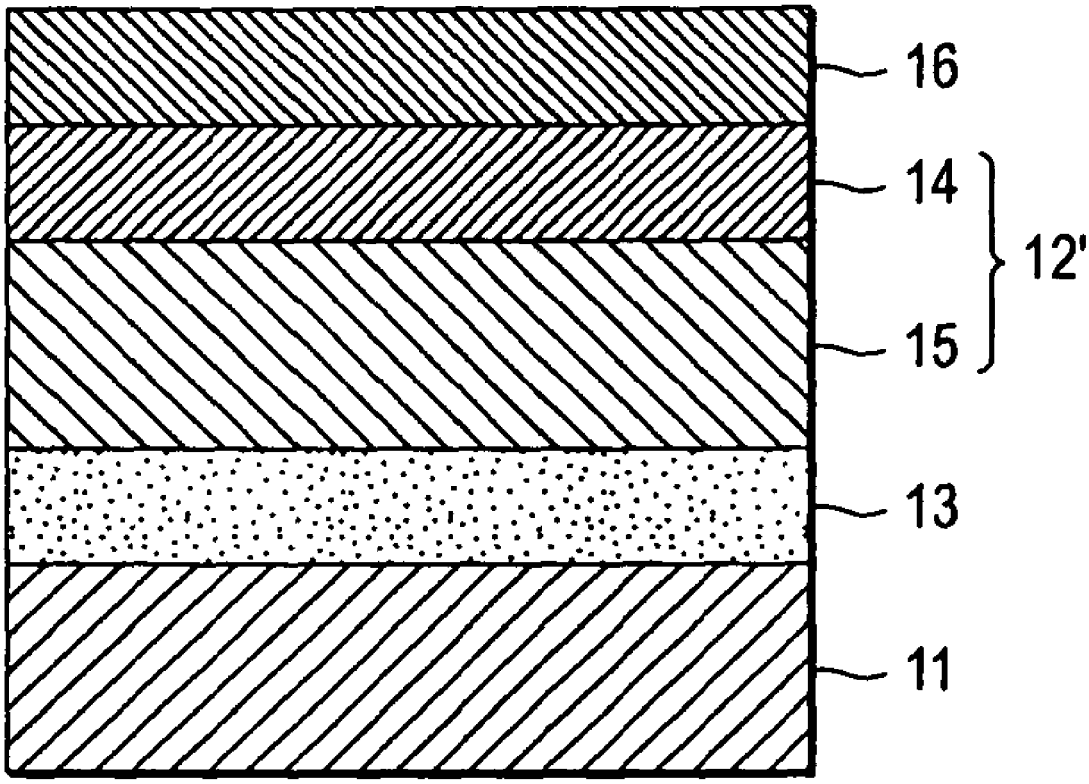
FIG. 2 is a typical enlarged sectional view showing another exemplary embodiment of the layer constitution of the electrophotographic photoreceptor according to an aspect of the invention.
Figure 3:
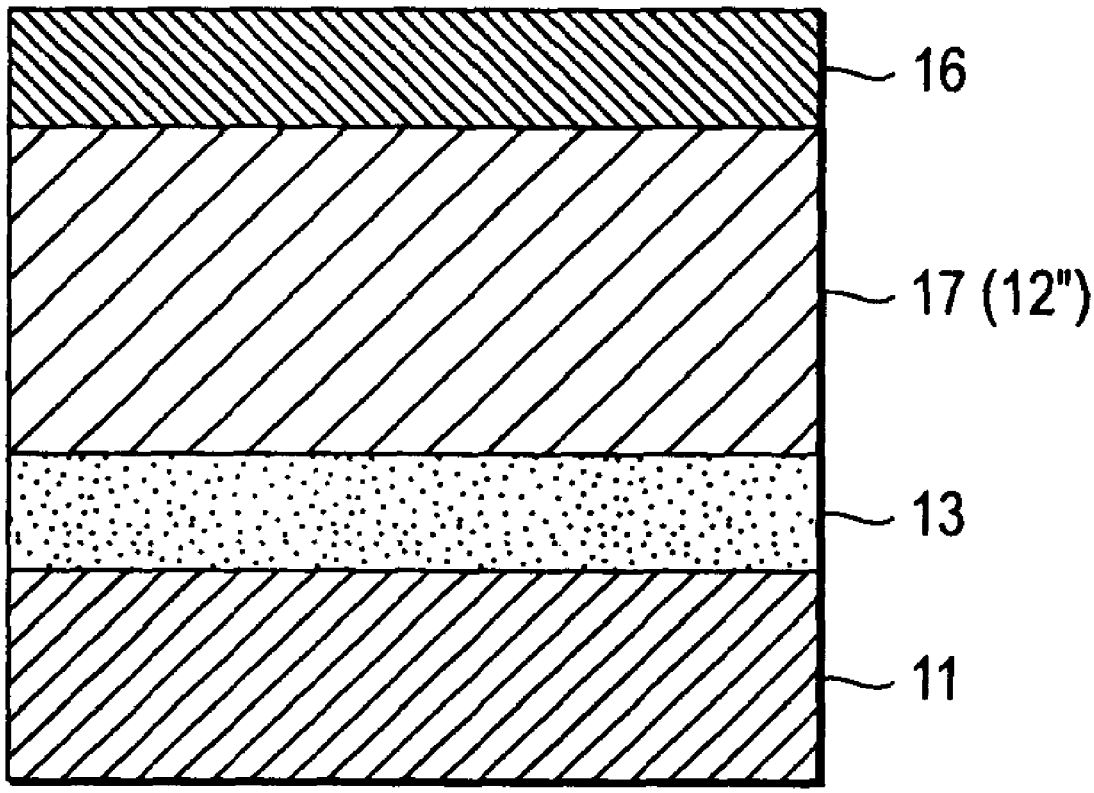
FIG. 3 is a typical enlarged sectional view showing another exemplary embodiment of the layer constitution of the electrophotographic photoreceptor according to the invention.

FIGS. 1 to 3 show exemplary embodiments of the layer constitution of the electrophotographic photoreceptors according to the invention. These drawings are typical cross sections showing part of the electrophotographic photoreceptors. The electrophotographic photoreceptors shown in FIGS. 1 and 2 have a charge generating layer and a charge transporting layer formed separately (functional separation type photoreceptors), while the electrophotographic photoreceptor shown in FIG. 3 has a photosensitive layer of the single layer type functioning as a charge generating layer as well as a charge transporting layer.

More specifically speaking, the electrophotographic photoreceptor shown in FIG. 1 has an intermediate layer 13, a charge generating layer 14, a charge transporting layer 15 and a surface protective layer 16 formed in this order on the surface of a conductive support 11 and the charge generating layer 14 and the charge transporting layer 15 constitute a photosensitive layer 12. In FIG. 2, the electrophotographic photoreceptor has an intermediate layer 13, a charge transporting layer 15, a charge generating layer 14 and a surface protective layer 16 formed in this order on the surface of a conductive support 11. Namely, the charge generating layer 14 and the charge transporting layer 15 constituting a photosensitive layer 12' are layered in a different order from in FIG. 1. The electrophotographic photoreceptor shown in FIG. 3 has an intermediate layer 13, a single layer type photosensitive layer (charge generating/charge transporting layer) 17 and a surface protective layer 16 formed in this order on the surface of a conductive support 11 and the single layer type photosensitive layer alone constitute a photosensitive layer 12".

Next, the constitutions of the individual layers will be first described by referring to FIGS. 1 to 3 and then the surface roughnesses of the conductive support and the surface protective layer, i.e. the characteristic of the invention, will be collectively described.

<Conductive Support>

Examples of the conductive support 11 include a metal plate, a metal drum or a metal belt using a metal such as aluminum, copper, zinc, stainless steel, chromium, nickel, molybdenum, vanadium, indium, gold or platinum or an alloy thereof; and a paper, a plastic film or a belt on which is coated, vacuum deposited or laminated a conductive polymer, a conductive compound such as indium oxide or a metal or alloy of aluminum, palladium or gold. The conductive support may be used in an appropriate shape such as a drum, a sheet, a plate or the like, but is not limited to such shapes.

In the case of using the electrophotographic photoreceptor in a laser printer, the emission wavelength of the laser is preferably from 350 nm to 850 nm. A shorter wavelength within this range can provide a higher resolution.

In order to prevent interference fringes to be generated upon irradiation with a laser light and to ensure the desired surface roughness as defined in the invention, the surface of the conductive support 11 is preferably roughened.

Preferable examples of a method of roughening the surface of the conductive support 11 include a wet honing method conducted by blasting a suspension of an abrasive in water against the support, a centerless grinding method wherein grinding is continuously conducted by press-contacting the support against a rotating grinding wheel, and an anodic oxidation method.

The anodic oxidation treatment is a treatment wherein anodic oxidation of aluminum is conducted in an electrolyte solution with the aluminum being an anode to thereby form an aluminum oxide film on the surface of aluminum. Examples of the electrolyte solution include a solution of sulfuric acid and a solution of oxalic acid. However, the thus-produced porous anodized film is chemically active as such and is liable to be stained, and undergoes a large change in resistance depending upon surrounding conditions. It is therefore preferable that the anodized aluminum plate is subjected to pore-sealing treatment wherein fine pores in the anodic oxidation film are closed by expansion of volume caused by hydration reaction in pressed steam or boiling water (optionally containing a salt of a metal such as nickel) and are converted to more stable hydrated oxide. The thickness of the anodized film is preferably from 0.3 to 15 μm. In case where the thickness is less than 0.3 μm, there results a poor barrier property against charge injection and thus no sufficient effect can be achieved in some cases. In case where the thickness is more than 15 μm, on the other hand, it is feared that there results an increase in residual potential after repeated uses.

It is also preferable treat the surface by conducting a treatment with an acidic treating solution or a Boehmite treatment.

In the treatment with an acidic treating solution, use can be made of a solution including phosphoric acid, chromic acid, hydrofluoric acid or the like. As to the proportion of phosphoric acid, chromic acid and hydrofluoric acid in the acidic treating solution, the concentration of phosphoric acid is in the range of from 10 to 11% by weight, the concentration of chromic acid is in the range of from 3 to 5% by weight, and the concentration of hydrofluoric acid is in the range of from 0.5 to 2% by weight, with the total concentration of these acids being in the range of preferably from 13.5 to 18% by weight. The treating temperature is from 42 to 48° C. A thicker film can be obtained with a higher speed by keeping the treating temperature at a higher level. The thickness of the film thus formed is preferably from 0.3 to 15 μm. In case where the thickness is less than 0.3 μm, there results a poor barrier property against charge injection and thus no sufficient effect can be achieved in some cases. In case where the thickness is more than 15 μm, on the other hand, it is feared that there results an increase in residual potential after repeated uses.

The boehmite treatment can be conducted by dipping the support in pure water at 90 to 100° C. for 5 to 60 minutes or by contacting with a heated steam at 90 to 120° C. for 5 to 60 minutes. The thickness of the film thus formed is preferably from 0.1 to 5 μm. The thus-treated product may further be subjected to the anodic oxidation treatment using an electrolyte solution having a low film-dissolving ability such as a solution of adipic acid, boric acid, a borate, a phosphate, a phthalate, a maleate, a benzoate, a tartarate or a citrate.

<Intermediate Layer>

In the examples of FIGS. 1 to 3, an intermediate layer 13 is formed in order to maintain excellent image qualities. In the invention, however, the intermediate layer is not essentially required. However, particularly in the case where the conductive support has been subjected to the treatment with an acidic solution or to the boehmite treatment, defects-covering ability of the conductive support tends to become insufficient, and hence it is preferred in this case to provide the intermediate layer 13.

Upon charging, the intermediate layer 13 inhibits the charge injection from the conductive support 11 to the photosensitive layer 12 and also serves as an adhesive layer whereby the photosensitive layer 12 is adhered to the conductive support and held together. In some cases, moreover, it is possible to impart to the intermediate layer 13 an antireflective effect on the conductive support.

To improve the characteristics of the photoreceptor, the intermediate layer 13 may contain a conductive substance. Examples of the conductive substance include metal oxides such as titanium oxide, zinc oxide and tin oxide, though any known conductive substance can be used so long as the desired characteristics of the photoreceptor can be obtained thereby.

The metal oxide can be surface-treated. By the surface-treatment, the resistance and dispersibility can be controlled and the characteristics of the photoreceptor can be improved. As the surface-treating agent, use can be made of publicly known materials such as a zirconium chelate compound, a titanium chelate compound, an aluminum chelate compound, a titanium alkoxide compound, an organic titanium compound and a silane coupling agent. Either one of these compounds or a mixture or a polycondensation product including two or more thereof may be used. Among all, a silane coupling agent is excellent in properties, for example, having a low residual potential, showing little potential change depending on environmental conditions, showing little potential change in repeated use and being excellent in image qualities.

Examples of the silane coupling agent are the same as those which will be cited hereinafter concerning the charge generating layer. In addition, use can be made of various known compounds as a zirconium chelate compound, a titanium chelate compound, an aluminum chelate compound, a titanium oxide compound and an organic titanium compound.

Although any known surface-treating method may be used, examples thereof include the dry process and the wet process.

Now, a surface treatment with a silane coupling agent will be described by way of example. In the surface treatment by the dry process, the silane coupling agent optionally dissolved in an organic solvent is dropped into metal oxide microparticles under agitated in, for example, a mixer with a large shear force. Next, the mixture is sprayed together with dry air or nitrogen gas to thereby conduct even surface treatment. It is preferable that the dropping of the silane coupling agent and the spraying of the mixture are carried out at a temperature not higher than the boiling point of the solvent employed. When the dropping or the spraying is carried out at a temperature exceeding the boiling temperature of the solvent, there arises a tendency that the solvent is evaporated and the silane coupling agent topically weights before even agitation is made so that the even treatment can be hardly conducted.

The thus surface-treated metal oxide particles may be further baked at 100° C. or higher. The baking may be carried out at an arbitrary temperature for an arbitrary time so long as the desired electrophotographic characteristics can be obtained.

In the surface treatment by the wet process, metal oxide microparticles are dispersed in a solvent by agitation or ultrasonication or using a sand mill, an attritor, a ball mill or the like and then a solution of a silane coupling agent is added thereto. After agitating or dispersing, the solvent is removed to thereby conduct even treatment. It is preferable to remove the solvent by distillation. When the solvent is removed by filtration, the unreacted silane coupling agent frequently flows out, which makes it difficult to control the amount of the silane coupling agent to achieve the desired characteristics.

After removing the solvent, the metal oxide microparticles may be further baked at 100° C. or higher. The baking may be carried out at an arbitrary temperature for an arbitrary time so long as the desired electrophotographic characteristics can be obtained. As the method of removing the moisture contained in the metal oxide particles in the wet process, use can be made of a method including heating the particles in the solvent to be used in the surface treatment under agitating to thereby remove the solvent and a method including conducting azeotropic distillation with the solvent.

The amount of the silane coupling agent to the metal oxide microparticles in the intermediate layer 13 may be at any ratio so long as the desired electrophotographic characteristics can be obtained. Also, the ratio of the metal oxide microparticles to the resin in to be used in the intermediate layer 13 may be at any level so long as the desired electrophotographic characteristics can be obtained.

To improve light scattering properties and so on, the intermediate layer 13 may further contain various organic or inorganic micropowders. Preferable examples of these micropowders include inorganic pigments (inorganic micropowders) as white pigments such as titanium oxide, zinc oxide, zinc sulfide, lead white and lithopone and extender pigments such as alumina, calcium carbonate and barium sulfate; and organic micropowders such as Teflon (trademark), resin particles, benzoguanamine resin particles and styrene resin particles. The particle diameter of such a micropowder preferably ranges from 0.01 to 2 μm. These micropowders are optional components to be added if needed. In the case of adding a micropowder, the content thereof is preferably from 10 to 80% by weight, more preferably from 30 to 70% by weight, on the basis of the total solid matters contained in the intermediate layer 13.

A coating solution to be used for forming the intermediate layer 13 (a coating solution for forming intermediate layer) may contain various additives to improve the electrical characteristics, the environmental stability and the image qualities. Examples of the additives that can be added include an electron transporting substance and polycyclic condensation type or azo type electron transporting pigments such as chloranil, bromoanil, a quinone-based compound such as anthraquinone; a tetracyanoquinodimethane-based compound, a fluorenone-based compound such as 2,4,7-trinitrofluorenone and 2,4,5,7-tetranitro-9-fluorenone and an oxadiazole-based compound such as 2-(4-biphenyl)-5-(4-t-butylphenyl)-1,3,4-oxadiazole, 2,5-bis(4-naphthyl)-1,3,4-oxadiazole and 2,5-bis(4-diethylaminophenyl)-1,3,4-oxadiazole; a xanthone-based compound, a thiophene compound and a diphenoquinone compound such as 3,3',5,5'-tetra-t-butyldiphenoquinone.

The coating solution for forming intermediate layer can be prepared by dispersing and mixing various components constituting the intermediate layer in an appropriate solvent. In the case where the micropowder of a conductive substance or a light scattering substance as described above is mixed in preparing the coating solution for forming intermediate layer, it is preferable to add the micropowder to a solution having the resin component dissolved therein followed by a dispersing treatment. Examples of the method of dispersing the micropowder in the coating solution include those using a dispersion device such as a roll mill, a ball mill, a vibration ball mill, an attritor, a sand mill, a colloid mill or a paint shaker.

Further, as a method for coating the coating solution for forming intermediate layer, there may be employed a common method such as a blade coating method, a wire bar coating method, a spray coating method, a dip coating method, a bead coating method, an air knife coating method or a curtain coating method.

It is preferable that the thickness of the intermediate layer 13 is not more than 50 μm, more preferably from 15 to 25 μm. It is not preferable that the thickness exceeds 50 μm, since a ghost image frequently appears, the cycle characteristics are deteriorated and the residual potential tends to accumulate. When the thickness is less than 15 μm, on the other hand, fogging frequently arises and it becomes difficult to avoid interference.

<Photosensitive Layer>

Photosensitive layers 12, 12' and 12" appropriately include a charge generating layer 14 and a charge transporting layer 15 that are functionally separated as shown in FIGS. 1 and 2 or a single layer type photosensitive layer 17 as shown in FIG. 3.

Next, the individual layers will be described.

(Charge Generating Layer)

The charge generating layer 14 mainly includes a charge generating material and a binder resin.

As the charge generating material, use can be made of known ones, e.g., organic pigments exemplified by azo pigments such as bis-azo pigments and tris-azo pigments, condensed ring-containing aromatic pigments such as dibromoanthoanthrone, organic pigments such as perylene pigments, pyrrolopyrrol pigments and phthalocyanine pigments; and inorganic pigments exemplified by trigonal selenium and zinc oxide, without specific restriction. It is particularly preferable to use a metal phthalocyanine pigment and a metal-free phthalocyanine pigment. Among all, hydroxygallium phthalocyanine disclosed in JP-A-5-263007 and JP-A-5-279591, chlorogallium phthalocyanine disclosed in JP-A-5-98181, dichlorotin phthalocyanine disclosed in JP-A-5-140472 and JP-A-5-140473, and titanyl phthalocyanine disclosed in JP-A-4-189873 and JP-A-5-43813, each having specific crystals, are particularly preferred.

The charge generating material preferable usable in the charge generating layer 14 can be produced by treating pigment crystals, that have been produced by a publicly known method, by a mechanical dry milling process with the use of, for example, an automated mortar, a planet mill, a vibration mill, a CF mill, a roller mill, a sand mill or a kneader, optionally followed by a wet milling process with the use of, for example, a ball mill, a mortar, a sand mill or a kneader together with a solvent.

Examples of the solvent to be used in the wet milling treatment include aromatic solvents (for example, toluene and chlorobenzene), amides (for example, dimethylformamide and N-methylpyrrolidone), aliphatic alcohols (for example, methanol, ethanol and butanol), aliphatic polyhydric alcohols (for example, ethylene glycol, glycerol and polyethylene glycol), aromatic alcohols (for example, benzyl alcohol and phenethyl alcohol), esters (for example, ethyl acetate and butyl acetate), ketones (for example, acetone and methyl ethyl ketone), dimethyl sulfoxide, ethers (for example, diethyl ether and tetrahydrofuran), mixtures of several solvents selected therefrom, or a solvent mixture of water with such a solvent.

It is preferable to use the solvent in an amount of from 1 to 200 parts by weight, more preferably from 10 to 100 parts by weight, per part by weight of the pigment crystals. In the wet milling treatment, the treatment temperature is 0° C. or higher but not higher than the boiling point of the solvent, preferably from 10 to 60° C. In the milling treatment, use may be made of a milling auxiliary such as sodium chloride or mirabilite. The milling auxiliary may be used in an amount 0.5 to 20 times, preferably 1 to 10 times, as much as the pigment on the weight basis.

In using pigment crystals produced by a publicly known method, it is also possible to control the crystals by acid pasting or a combination of acid pasting with the dry milling treatment or the wet milling treatment as described above. As the acid to be used in the acid pasting, sulfuric acid is preferred. As the sulfuric acid, use is made of so-called conc. sulfuric acid having a concentration of 70 to 100% by weight, preferably 95 to 100% by weight. The amount of the conc. sulfuric acid is controlled within the range of 1 to 100 times, preferably 3 to 50 times (each on the weight basis), as much as the weight of the pigment crystals. The dissolution temperature is controlled within the range of −20 to 100° C., preferably 0 to 60° C. As the solvent to be used in precipitating the crystals from the acid, use can be made of water or a mixture of water with an organic solvent in an arbitrary amount. Although the precipitation temperature is not particularly restricted, it is preferable to cool the reaction mixture with ice or the like so as to prevent heat generation.

The charge generating material may be coated with an organic metal compound having a hydrolyzable group or a silane coupling agent. Owing to this coating treatment, the dispersibility of the charge generating material and the coating suitability of the coating solution for forming charge generating layer are improved and thus a smooth and uniformly dispersed charge generating layer 14 can be easily and surely formed. As a result, image defects such as fogging and ghost image can be prevented and the image sustaining properties can be improved. Furthermore, the storage stability of the coating solution for forming charge generating layer is highly improved thereby, which brings about an advantage of prolonging the pot life and contributes to the cost down of the photoreceptor.

The organic metal compound having a hydrolyzable group as described above is a compound represented by the following general formula (A).

$$R_p\text{-}M\text{-}Y_q \qquad \text{General formula (A)}$$

(In the general formula (A), R represents an organic group; M represents a metal atom other than alkali metals or a silicon atom; Y represents a hydrolyzable group; and each of p and q is an integer of 1 to 4, provided that p+q corresponds to the atomic valence of M.)

Examples of the organic group represented by R in the general formula (A) include alkyl groups such as a methyl group, an ethyl group, a propyl group, a butyl group and an octyl group; alkenyl groups such as a vinyl group and an allyl group; cycloalkyl groups such as a cyclohexyl group; aryl groups such as a phenyl group, a tolyl group and a naphthyl group; arylalkyl groups such as a benzyl group and a phenylethyl group; arylalkenyl groups such as a styryl group; and heterocyclic groups such as a furyl group, a thienyl group, a pyrrolidinyl group, a pyridyl group and an imidazolyl group. These organic groups may have one or more substituents selected from among various ones.

Examples of the hydrolyzable group represented by Y in the general formula (A) include ether groups such as a methoxy group, an ethoxy group, a propoxy group, a butoxy group, a cyclohexyloxy group, a phenoxy group and benzyloxy group; ester groups such as an acetoxy group, a propionyloxy group, an acryloxy group, a methacryloxy group, a benzoyloxy group, a methanesulfonyloxy group, a benzenesulfonyloxy group and a benzyloxycarbonyl group; and halogen atoms such as a chlorine atom.

Although the metal or silicon atom represented by M in the general formula (A) is not particularly restricted so long as it is not an alkali metal, preferable examples thereof include a titanium atom, an aluminum atom, a zirconium atom or a silicon atom. Namely, it is preferable in the photoreceptor according to the invention to use an organic titanium compound, an organic aluminum compound or an organic zirconium compound, each having the above-described organic group and hydrolyzable group as functional substituents, or a silane coupling agent.

Examples of the silane coupling agent as described above include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, γ-chloropropyltrimethoxysilane, vinyltriethoxysilane, vinyl-tris(2-methoxyethoxysilane), 3-methacryloxypropyltrimethoxysilane, 3-glycidoxypropyltrimethoxysilane, 2-(3,4-epoxycyclohexyl)ethyltrimethoxysilane, N-β-(aminoethyl)-3-aminopropyltrimethoxysilane, N-β-(aminoethyl)-3-aminopropylmethyldimethoxysilane, 3-aminopropyltriethoxysilane, N-phenyl-3-aminopropyltrimethoxysilane, 3-mercaptopropyltrimethoxysilane and 3-chloropropyltrimethoxysilane.

Among these silane coupling agents, still preferable ones are vinyltriethoxysilane, vinyl-tris(2-methoxyethoxy)silane, 3-methacryloxypropyltrimethoxysilane, 3-glycidoxypropyltrimethoxysilane, 2-(3,4-epoxycyclohexyl)ethyltrimethoxysilane, N-2-(aminoethyl)-3-aminopropyltrimethoxysilane, N-2-(aminoethyl)-3-aminopropylmethyldimethoxysilane, 3-aminopropyltriethoxysilane, N-phenyl-3-aminopropyltrimethoxysilane, 3-mercaptopropyltrimethoxysilane and 3-chloropropyltrimethoxysilane.

It is also possible to use hydrolyzates of the organic metal compounds and the silane coupling agents as described above. As these hydrolyzates, there can be enumerated an organic metal compound of the general formula (A) wherein Y (a hydrolyzable group) attached to M (a metal atom other than alkali metals or a silicon atom) or a hydrolyzable group attached as a substituent to R (an organic group) has been hydrolyzed. In the case where the organic metal compound and the silane coupling agent have a plural number of hydrolyzable groups, it is not always necessary to hydrolyze all of the functional groups. That is, use can be made of a partially hydrolyzed product. Either one of these organic metal compounds and silane coupling agents or a mixture of two or more thereof may be used.

As a method of coating a phthalocyanine pigment with the organic metal compound having a hydrolyzable group and/or the silane coupling agent as described above (hereinafter referred to simply as "organic metal compound"), there can be enumerated: 1) a method including coating a phthalocyanine pigment in the course of controlling the phthalocyanine pigment crystals; 2) a method including coating a phthalocyanine pigment before dispersing it in a binder resin; 3) a method including mixing an organic metal compound in the step of dispersing a phthalocyanine pigment in a binder resin; and 4) a method including dispersing a phthalocyanine pigment in a binder resin followed by a dispersion treatment using an organic metal compound.

Now, each method will be described more specifically. Examples of the method 1), which includes coating a phthalocyanine pigment in the course of controlling the phthalocyanine pigment crystals, include: a method including mixing an organic metal compound with a phthalocyanine pigment before controlling the crystals and then heating; a method including adding an organic metal compound to a phthalocyanine pigment before controlling the crystals and then mechanically dry-milling; and a method including mixing a solution of an organic metal compound in water or an organic solvent with a phthalocyanine pigment before controlling the crystals and then wet-milling.

Examples of the method 2), which includes coating a phthalocyanine pigment before dispersing it in a binder resin, include: a method including mixing an organic metal compound, water or a liquid mixture of water with an organic solvent and a phthalocyanine pigment and then heating; a method including directly spraying an organic metal compound to a phthalocyanine pigment; and a method of mixing an organic metal compound with a phthalocyanine pigment and then milling.

Examples of the method 3), which includes conducting a mixing treatment in the step of dispersing, include: a method including successively adding an organic metal compound, a phthalocyanine pigment and a binder resin to a dispersion solvent and mixing; and a method including adding these charge generating layer (14)-constituting components at the same time and mixing.

As an example of the method 4), which includes dispersing a phthalocyanine pigment in a binder resin followed by a dispersion treatment using an organic metal compound, there can be enumerated a method including adding an organic metal compound diluted with a solvent to a dispersion and dispersing under agitating. To stick more strongly to the phthalocyanine pigment in the dispersion treatment, an acid such as sulfuric acid, hydrochloric acid or trifluoroacetic acid may be added as a catalyst.

Among these methods, the method 1) including coating a phthalocyanine pigment in the course of controlling the phthalocyanine pigment crystals and the method 2) including coating a phthalocyanine pigment before dispersing it in a binder resin are preferred.

The binder resin can be selected from a wide scope of insulating resins. It may also be selected from organic photoconductive polymers such as poly-N-vinylcarbazole, polyvinylanthracene, polyvinylpyrene and polysilane. Preferred examples of the binder resin include insulating resins such as a polyvinyl butyral resin, a polyarylate resin (e.g., a polycondensate between bisphenol A and phthalic acid), a polycarbonate resin, a polyester resin, a phenoxy resin, a vinyl chloride-vinyl acetate copolymer, a polyamide resin, an acryl resin, a polyacrylamide resin, a polyvinylpyridine resin, a cellulose resin, a urethane resin, an epoxy resin, casein, a polyvinyl alcohol resin and a polyvinylpyrrolidone resin, though the invention is not restricted thereto. Either one of these binder resins or a combination of two or more thereof may be used.

The ratio by weight of the charge generating material to the binder resin is in the range of preferably from 10:1 to 1:10. The charge generating layer 14 can be formed by coating a coating solution for forming charge generating layer containing the charge generating material and the binder resin. As the solvent to be used for dispersing the charge generating material and the binder resin, use can be made of any solvent without restriction, so long as the binder resin is soluble therein. For example, it is possible to use common organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxoane, tetrahydrofuran, methylene chloride, chloroform, chlorobenzene and toluene either singly or in combination of two or more thereof.

As the method to be employed for dispersing the charge generating material and the binder resin in the solvent, use can be made of common methods such as a ball mill dispersing method, an attritor dispersing method and a sand mill dispersing method. However, it is preferable to carry out the dispersion under such conditions that the charge generating material does not undergo change in crystal form. Further, upon dispersion, it is effective to adjust the particle size of the charge generating material to 0.5 μm or less, preferably 0.3 μm or less, more preferably 0.15 μm or less.

As the method for coating the coating solution, use can be made of common methods such as a blade coating method, a Meyer bar coating method, a spray coating method, a dip coating method, a bead coating method, an air knife coating method and a curtain coating method.

The thickness of the charge generating layer 14 is generally from 0.1 to 5 μm, preferably from 0.2 to 2.0 μm.

(Charge Transporting Layer)

The charge transporting layer 15 is constituted by a charge transporting material and a binder resin or by a high molecular charge transporting material.

Examples of the charge transporting material to be used in the charge transporting layer 15 include oxadiazole derivatives such as 2,5-bis(p-diethylaminophenyl)-1,3,4-oxadiazole; pyrazoline derivatives such as 1,3,5-triphenylpyrazoline and 1-[pyridyl-(2)]-3-(p-diethylaminostyryl)-5-(p-diethylamino styryl)pyrazoline; aromatic tertiary amino compounds such as triphenylamine, tri(p-methylphenyl)aminyl-4-amine and dibenzylaniline; aromatic tertiary diamino compounds such as N,N'-bis(3-methylphenyl)-N,N'-diphenylbenzidine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenyl hydrazone; quinazoline derivatives such as 2-phenyl-4-styryl-quinazoline; benzofuran derivatives such as 6-hydroxy-2,3-di(p-methoxyphenyl)benzofuran; α-stilbene derivatives such as p-(2,2-diphenylvinyl)-N,N-diphenylaniline; hole transporting substances such as enamine derivatives, carbazole derivatives such as N-ethylcarbazole, poly-N-vinylcarbazole and its derivatives; quinone-based compounds such as chloranil and broanthraquinone, tetracyanoquinodimethane-based compounds, fluorenone compounds such as 2,4,7-trinitrofluorenone and 2,4,5,7-tetranitro-9-fluorenone; electron transporting materials such as xanthone-based compounds and thiophene compounds; and polymers having a residue formed by removing a hydrogen atom or the like from the above compounds in the main chain or side chain thereof. These charge transporting materials may be used either singly or combinedly.

Examples of the binder resin to be used in the charge transporting layer 15 include insulating resins such as an acrylic resin, polyarylate, a polyester resin, a polycarbonate resin of bisphenol A type or bisphenol Z type, polystyrene, an acrylonitrile-styrene copolymer, an acrylonitrile-butadiene copolymer, polyvinyl butyral, polyvinyl formal, polysulfone, polyacrylamide, polyamide and a chlorinated rubber, and organic photoconductive polymers such as polyvinylcarbazole, polyvinyl anthracene and polyvinyl pyrene. These binder resins may be used either singly or combinedly.

It is also possible to use a high molecular charge transporting material alone. As the high molecular charge transporting material, use can be made of a publicly known compound having a charge transporting ability such as poly-N-vinylcarbazole or polysilane. In particular, polyester-based high molecular charge transporting materials disclosed by JP-A-8-176293 and JP-A-8-208820 are preferred due to their high charge transporting ability. The high molecular charge transporting material may be used alone as the component of the charge transporting layer. Alternatively, it may be formed into a film by mixing with the above-described binder resin.

The charge transporting layer 15 can be formed by coating a coating solution for forming charge transporting layer, which includes the charge transporting material and the binder resin (the binder resin being unnecessary in the case of using the high molecular charge transporting material alone) dissolved and/or dispersed in an appropriate solvent, and drying it. Examples of a solvent to be used for the coating solution for forming charge transporting layer include aromatic hydrocarbons such as toluene and chlorobenzene; aliphatic alcohol solvents such as methanol, ethanol and n-butanol; ketone solvents such as acetone, cyclohexanone and 2-butanone; halogenated aliphatic hydrocarbon solvents such as methylene chloride, chloroform and ethylene chloride; cyclic or straight-chain ether solvents such as tetrahydrofuran, dioxane and ethyl ether; and mixtures thereof. The composition ratio by weight of the charge transporting material to the binder resin preferably ranges from 10:1 to 1:5, more preferably from 9:11 to 3:7.

Examples of the method of coating the coating solution for forming charge transporting layer include commonly employed methods such as a blade coating method, a Meyer bar coating method, a dip coating method, a cross coating method, a spray coating method, a roll coating method, a gravure coating method, a bead coating method, an air knife coating method and a curtain coating method. The thickness of the charge transporting layer 15 is generally from 5 to 50 μm, preferably from 10 to 35 μm.

(Single Layer Type Photosensitive Layer)

A single layer type photosensitive layer 17 as shown in FIG. 3 includes the above-described charge generating material and a binder resin. As the binder resin, use can be made of the same ones as employed in the charge generating layer and the charge transporting layer. The content of the charge generating material in the single layer type photosensitive layer 17 is preferably from about 10 to about 85% by weight, more preferably from about 20 to about 50% by weight, based on the total solid matters in the single layer type photosensitive layer.

If necessary, the single layer type photosensitive layer 17 may further contain a charge transporting material or a high molecular charge transporting material as described above to, for example, improve the photoelectric characteristics. It is preferable to regulate the content thereof to 5 to 50% by weight based on the total solid matters in the single layer type photosensitive layer.

The single layer type photosensitive layer 17 can be formed by dissolving/dispersing the charge generating material and the binder resin, optionally together with the charge transporting material or the high molecular charge transporting material and other additives, in an appropriate solvent to prepare a coating solution in the form of a solution or a dispersion, applying the coating solution on the conductive support and then drying by heating. As the solvent and the coating method to be employed in the application, the same ones as described with respect to the charge generating layer and the charge transporting layer can be used. The thickness of the single layer type photosensitive layer 17 is preferably from about 5 to about 50 μm, more preferably from about 10 to about 40 μm.

(Whole Photosensitive Layer)

To prevent the electrophotographic photoreceptor from deterioration caused by ozone or oxidizing gases generated in an image forming apparatus or heat and light, it is possible to add an additive such as an antioxidant, a photostabilizer or a heat stabilizer to the photosensitive layer (either the charge generating layer or the charge transporting layer or both thereof and the single layer type photosensitive layer; the same will apply to the case of merely saying "photosensitive layer" hereinafter).

As the antioxidant, use can be made of publicly known ones, for example, hindered phenols, hindered amines, p-phenylenediamine, an arylalkane, hydroquinone, spirocoumarone, spiroindanone, derivatives of these compounds, organic sulfur compounds and organic phosphorus compounds. As the photostabilizer, use can be made of publicly known ones, for example, benzophenone, benzotriazole, dithiocarbamate, tetramethylpiperidine, and derivatives thereof. As the heat stabilizer, use can be made of publicly known ones.

For improving the sensitivity, reducing a residual potential and relieving fatigue due to repeated use, it is possible to add at least one electron accepting substance. Examples of the electron accepting substance usable in the electrophotographic photoreceptor of the invention include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. Among these compounds, fluorenone type compounds, quinone type compounds and benzene derivatives having an electron-withdrawing substituent such as $Cl^-$, $CN^-$ or $NO_2^-$ are particularly preferred.

<Surface Protective Layer>

Examples of the surface protective layer 16 include a layer wherein conductive microparticles are dispersed in a binder resin, a layer wherein lubricating microparticles made of a fluorine resin, an acrylic resin or the like are dispersed in a common charge transporting material and a layer using a hard coating agent such as a silicone resin or an acrylic resin. Also, there can be enumerated materials having a crosslinked structure such as a phenol-based resin, a urethane-based resin, an acrylic resin and a siloxane-based resin. In the invention, however, a surface protective layer at least including a phenol resin, a charge transporting substance having a reactive functional group and a leveling agent is preferable.

Although the charge transporting substance having a reactive functional group to be used in the surface protective layer 16 is not particularly restricted so long as a hard film can be formed therefrom, compounds having the structures represented by the following general formulae (I) to (VI) are particularly preferable from the viewpoints of mechanical strength and image quality-sustaining properties.

$$F[\text{-}D\text{-}Si(R^1)_{(3-n1)}Q_{n1}]_{m1}$$ General formula (I)

[In the general formula (I), F represents an organic group having a valency m1 that is derived from a compound having a charge transporting ability; $R^1$ represents a hydrogen atom, an alkyl group or a substituted or unsubstituted aryl group; Q represents a hydrolyzable group; n1 is an integer of 1 to 3; and m1 is an integer of 1 to 4.]

$$F\text{—}((X^1)_nR^2\text{-}Z^1H)$$ General formula (II)

[In the general formula (II), F represents an organic group having a valency m that is derived from a compound having a charge transporting ability; $R^2$ represents an alkylene group; $Z^1$ represents an oxygen atom, a sulfur atom, NH or COO; $X^1$ represents an oxygen atom or a sulfur atom; m is an integer of 1 to 4; and n is 0 or 1.]

$$F\text{—}[(X^2)_{n2}\text{—}(R^3)_{n3}\text{-}(Z^2)_{n4}G]_{n5}$$ General formula (III)

[In the general formula (IV), F represents an organic group having a valency n5 that is derived from a compound having a charge transporting ability; $X^2$ represents an oxygen atom or a sulfur atom; $R^3$ represents an alkylene group; $Z^2$ represents an alkylene group, an oxygen atom, a sulfur atom, NH or COO; G represents an epoxy group; each of n2, n3 and n4 independently represents 0 or 1; and n5 is an integer of 1 to 4.]

General formula (IV)

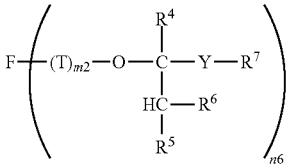

[In the general formula (IV), F represents an organic group having a valency n6 that is derived from a compound having a charge transporting ability; T represents a divalent group; Y represents an oxygen atom or a sulfur atom; each of $R^4$, $R^5$ and $R^6$ independently represents a hydrogen atom or a monovalent organic group and $R^7$ represents a monovalent organic group, provided that $R^6$ and $R^7$ may be bonded to each other to form a heterocycle having Y as the hetero atom; m2 is 0 or 1; and n6 is an integer of 1 to 4.]

General formula (V)

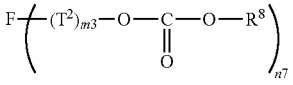

[In the general formula (V), F represents an organic group having a valency n7 that is derived from a compound having a charge transporting ability; $T^2$ represents a divalent group; $R^8$ represents a monovalent organic group; m3 is 0 or 1; and n7 is an integer of 1 to 4.]

General formula (VI)

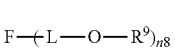

[In the general formula (VI), F represents an organic group having a valency n8 that is derived from a compound having a charge transporting ability; L represents an alkylmethylene group or an ethylene group; $R^9$ represents a monovalent organic group; and n8 is an integer of 1 to 4.]

As the organic group F in the above general formulae (I) to (VI), an organic group having the structure represented by the following general formula (VII) is preferable.

General formula (VII)

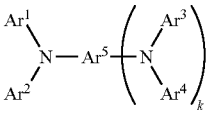

[In the general formula (VII), each of $Ar^1$ to $Ar^4$ independently represents a substituted or unsubstituted aryl group; $Ar^5$ represents a substituted or unsubstituted aryl group or an arylene group, provided that where $Ar^5$ is an aryl group, it is not bonded to N in the right side in the formula but exclusively to N in the left side to form the compound, and 2 to 4 groups among $Ar^1$ to $Ar^5$ have bonds to the respective counterparts in F in the above general formulae (I) to (VI); and k is 0 or 1.]

As specific examples of the substituted or unsubstituted aryl groups represented by $Ar^1$ to $Ar^5$ in the compound of the general formula (VII), those having the structures represented by the formulae (VII-1) to (VII-7) in the following Table 1 are preferred.

TABLE 1

| | |
|---|---|
| VII-1 | 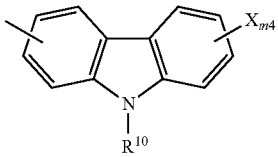 |
| VII-2 | 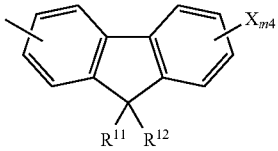 |
| VII-3 | 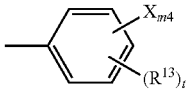 |
| VII-4 | 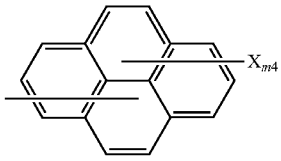 |
| VII-5 | 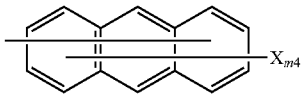 |

TABLE 1-continued

| | |
|---|---|
| VII-6 | 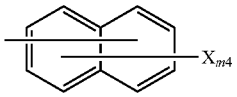 |
| VII-7 | —Ar—$Z_3$—Ar—$X_{m4}$ |

In the above formulae (VII-1) to (VII-7), $R^{10}$ represents a hydrogen atom, an alkyl group having 1 to 4 carbon atoms, an alkoxy group having 1 to 4 carbon atoms, a phenyl group substituted thereby or an unsubstituted phenyl group, or an aralkyl group having 7 to 10 carbon atoms; each of $R^{11}$ to $R^{13}$ independently represents a hydrogen atom, an alkyl group having 1 to 4 carbon atoms, an alkoxy group having 1 to 4 carbon atoms, a phenyl group substituted thereby or an unsubstituted phenyl group, an aralkyl group having 7 to 10 carbon atoms or a halogen atom; X represents a bond to the counterpart in F in the above general formulae (I) to (VI); Z represents an oxygen atom, a sulfur atom, NH or COO; Ar represents a substituted or unsubstituted aryl group; each of m4 and s independently represents 0 or 1; and each of t independently represents an integer of 1 to 3.

As Ar in the above general formula (VII-7), an aryl group represented by the following formula (VII-8) or (VII-9) is preferable.

TABLE 2

| | |
|---|---|
| VII-8 | 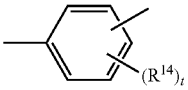 |
| VII-9 | 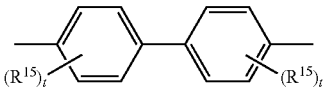 |

In the above formulae (VII-8) and (VII-9), each of $R^{14}$ and $R^{15}$ independently represents a hydrogen atom, an alkyl group having 1 to 4 carbon atoms, an alkoxy group having 1 to 4 carbon atoms, a phenyl group substituted thereby or an unsubstituted phenyl group, an aralkyl group having 7 to 10 carbon atoms or a halogen atom; and each of t independently represents an integer of 1 to 3.

As Z in the above general formula (VII-7), a divalent group represented by any of the following formulae (VII-10) to (VII-17) is preferable.

TABLE 3

| | |
|---|---|
| VII-10 | —$(CH_2)_q$— |
| VII-11 | —$(CH_2CH_2O)_r$— |
| VII-12 | 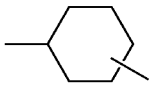 |
| VII-13 | 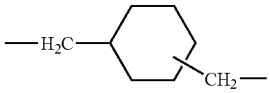 |
| VII-14 | 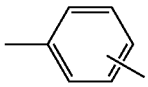 |

TABLE 3-continued

| | |
|---|---|
| VII-15 | 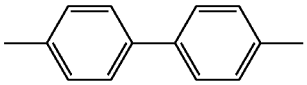 |
| VII-16 | 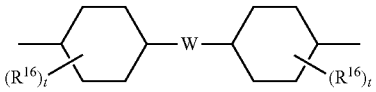 |
| VII-17 | 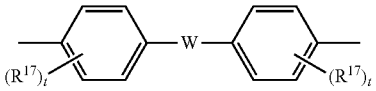 |

In the above formulae (VII-10) to (VII-17), each of $R^{16}$ and $R^{17}$ independently represents a hydrogen atom, an alkyl group having 1 to 4 carbon atoms, an alkoxy group having 1 to 4 carbon atoms, a phenyl group substituted thereby or an unsubstituted phenyl group, an aralkyl group having 7 to 10 carbon atoms or a halogen atom; each of q and r independently represents an integer of 1 to 10; and each of t independently represents an integer of 1 to 3.

Further, W in the above formulae (VII-16) and (VII-17) represents a divalent group represented by any of the following formulae (VII-18) to (VII-26).

TABLE 4

| | |
|---|---|
| VII-18 | —$CH_2$— |
| VII-19 | —$C(CH_3)_2$— |
| VII-20 | —O— |
| VII-21 | —S— |
| VII-22 | —$C(CF_3)_2$— |
| VII-23 | —$Si(CH_3)_2$— |
| VII-24 | 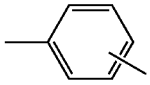 |
| VII-25 | 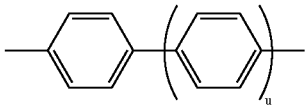 |
| VII-26 | 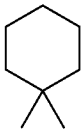 |

In the above formula (VII-25), u is an integer of 0 to 3.

Concerning the specific structures of $Ar^5$ in the above general formula (VII), in the case where k is 0, $Ar^5$ may have structures of the above (VII-1) to (VII-7) wherein m4 is 1, and, in the case where k is 1, $Ar^5$ may have structures of the above (VII-1) to (VII-7) wherein m4 is 0 and bond to adjacent nitrogens in the general formula (VII).

Next, specific examples of the charge transporting substance having a reactive functional group of the general formulae (I) to (VI) which is usable in the surface protective layer 16 as described above will be enumerated. In the symbols given in the individual structural formulae listed in the following Tables 5 to 18, each preceding Roman figure means to which one of the general formulae (I) to (VI) it corresponds as a specific example.

In the following Tables 5 to 18, a bond alone (symbole "-") and Me represent a methyl group, Et represents an ethyl group, and iPr represents an isopropyl group.

TABLE 5
| No. | Ar1 | Ar2 | Ar3 | Ar4 |
|---|---|---|---|---|
| I-1 | 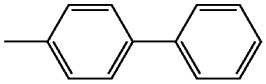 | 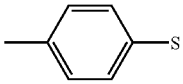 | — | — |
| I-2 | 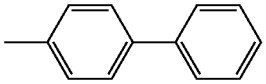 | 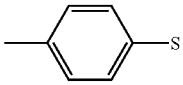 | — | — |
| I-3 | 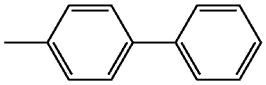 | 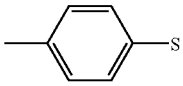 | — | — |
| I-4 | 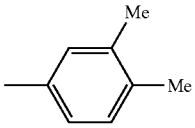 | 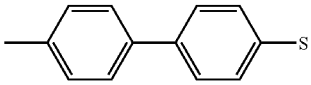 | — | — |
| I-5 | 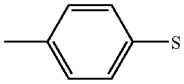 | 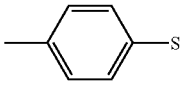 | — | — |
| I-6 | 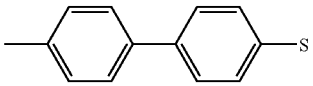 | 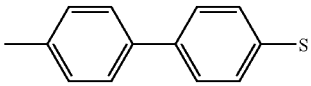 | — | — |
| I-7 | 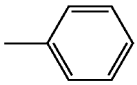 | 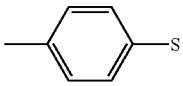 | 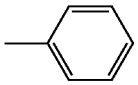 | 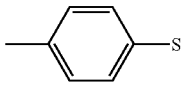 |
| I-8 | 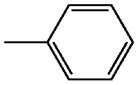 | 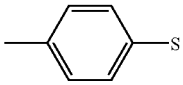 | 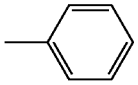 | 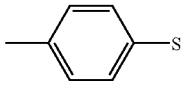 |
| I-9 | 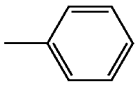 | 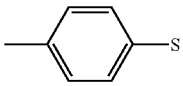 | 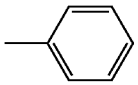 | 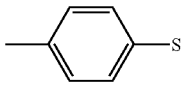 |
| I-10 | 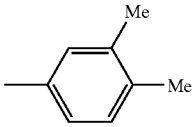 | 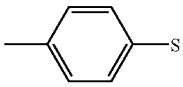 | 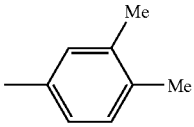 | 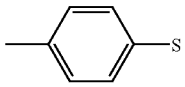 |
| No. | Ar5 | k | S |
|---|---|---|---|
| I-1 | 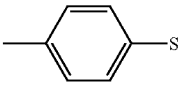 | 0 | —$(CH_2)_2$—COO—$(CH_2)_3$—Si(OiPr)$_3$ |
| I-2 | 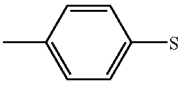 | 0 | —$(CH_2)_2$—COO—$(CH_2)_3$—Si(OiPr)$_2$Me |
| I-3 | 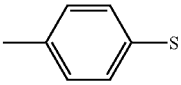 | 0 | —$(CH_2)_2$—COO—$(CH_2)_3$—Si(OiPr)Me$_2$ |
| I-4 | 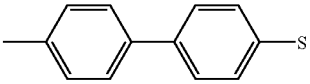 | 0 | —COO—$(CH_2)_3$—Si(OiPr)$_3$ |

TABLE 5-continued
| | | | |
|---|---|---|---|
| I-5 | 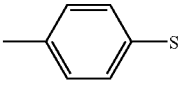 | 0 | —$(CH_2)_2$—COO—$(CH_2)_3$—Si(OiPr)$_3$ |
| I-6 | 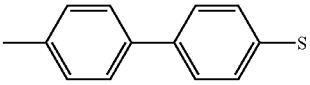 | 0 | —COO—$(CH_2)_3$—Si(OiPr)$_3$ |
| I-7 | 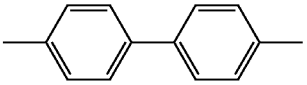 | 1 | —$(CH_2)_4$—Si(OEt)$_3$ |
| I-8 | 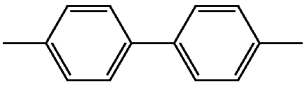 | 1 | —$(CH_2)_4$—Si(OiPr)$_3$ |
| I-9 | 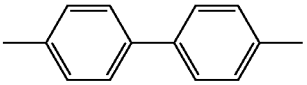 | 1 | —CH═CH—$(CH_2)_2$—Si(OiPr)$_3$ |
| I-10 | 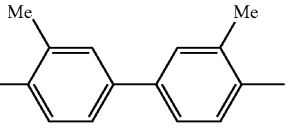 | 1 | —$(CH_2)_4$—Si(OMe)$_3$ |
TABLE 6
| No. | Ar1 | Ar2 | Ar3 | Ar4 |
|---|---|---|---|---|
| I-11 | 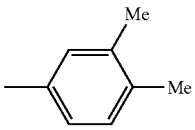 | 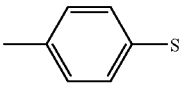 | 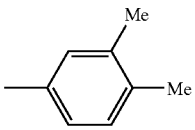 | 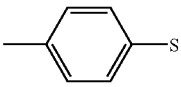 |
| I-12 | 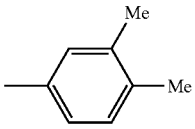 | 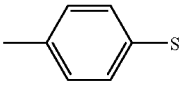 | 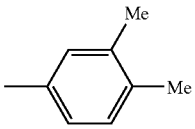 | 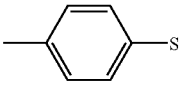 |
| I-13 | 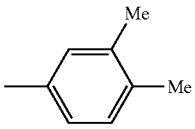 | 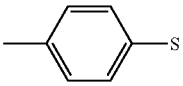 | 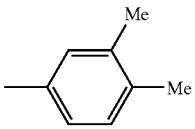 | 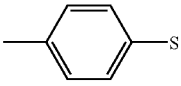 |
| I-14 | 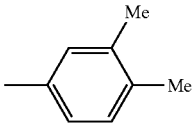 | 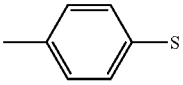 | 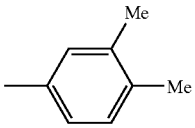 | 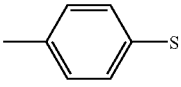 |
| I-15 | 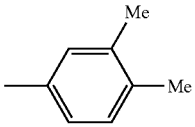 | 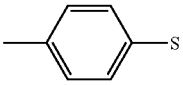 | 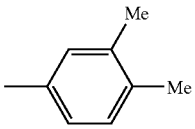 | 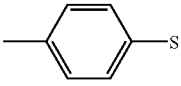 |

TABLE 6-continued
| | | | | |
|---|---|---|---|---|
| I-16 | 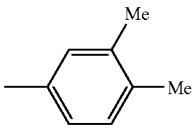 | 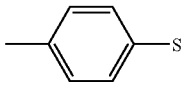 | 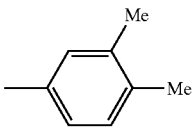 | 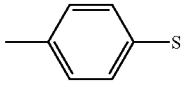 |
| I-17 | 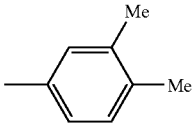 | 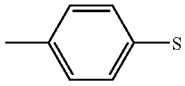 | 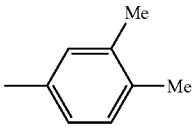 | 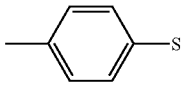 |
| I-18 | 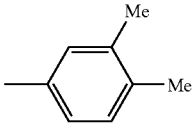 | 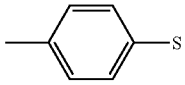 | 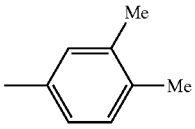 | 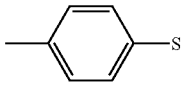 |
| I-19 | 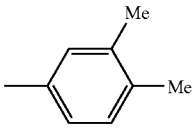 | 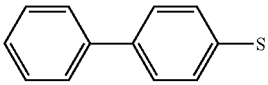 | 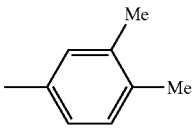 | 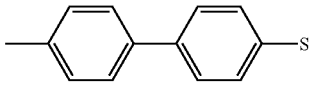 |
| I-20 | 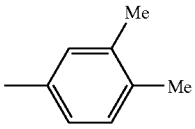 | 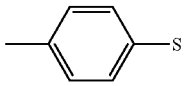 | 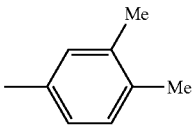 | 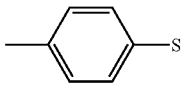 |
| No. | Ar5 | k | S |
|---|---|---|---|
| I-11 | 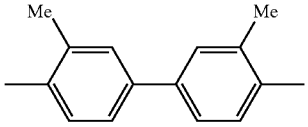 | 1 | —$(CH_2)_4$—Si(OiPr)$_3$ |
| I-12 | 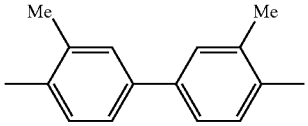 | 1 | —CH═CH—$(CH_2)_2$—Si(OiPr)$_3$ |
| I-13 | 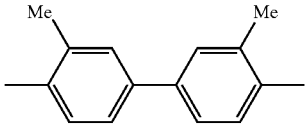 | 1 | —CH═N—$(CH_2)_3$—Si(OiPr)$_3$ |
| I-14 | 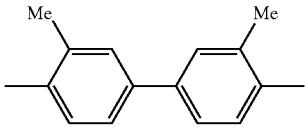 | 1 | —O—$(CH_2)_3$—Si(OiPr)$_3$ |
| I-15 | 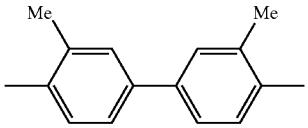 | 1 | —COO—$(CH_2)_3$—Si(OiPr)$_3$ |
| I-16 | 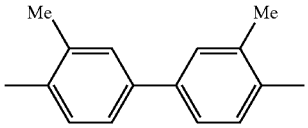 | 1 | —$(CH_2)_2$—COO—$(CH_2)_3$—Si(OiPr)$_3$ |

TABLE 6-continued
| | | | |
|---|---|---|---|
| I-17 | 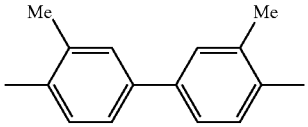 | 1 | —$(CH_2)_2$—COO—$(CH_2)_3$—Si(OiPr)$_3$Me |
| I-18 | 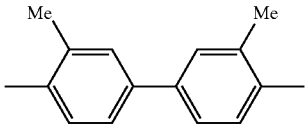 | 1 | —$(CH_2)_2$—COO—$(CH_2)_3$—Si(OiPr)Me$_2$ |
| I-19 | 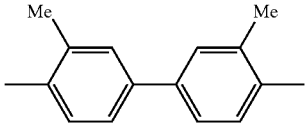 | 1 | —COO—$(CH_2)_3$—Si(OiPr)$_3$ |
| I-20 | 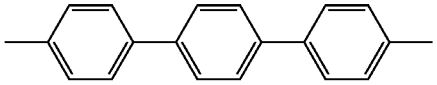 | 1 | —$(CH_2)_2$—Si(OiPr)$_3$ |
TABLE 7
II-1
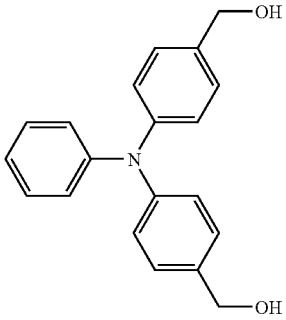
II-2
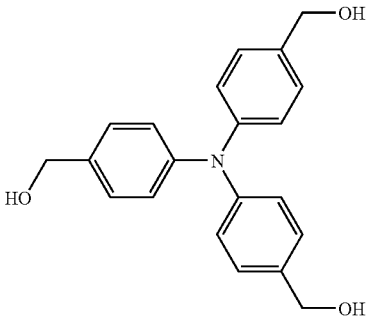
II-3
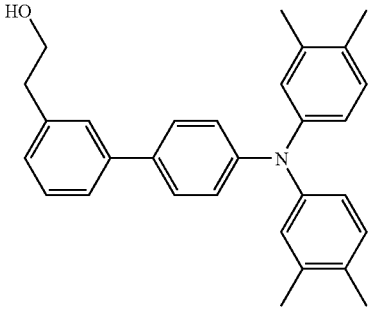
TABLE 7-continued
II-4
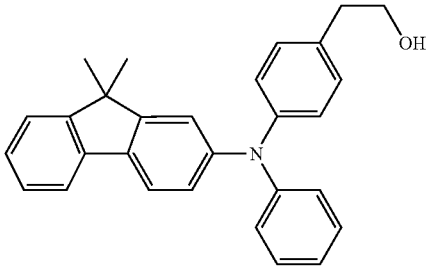
II-5
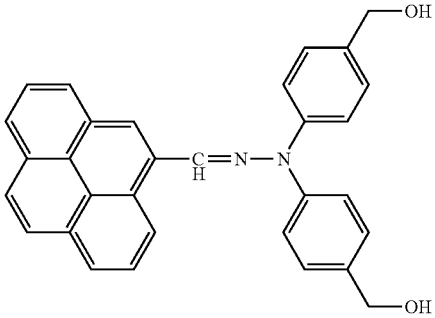
TABLE 8
II-6
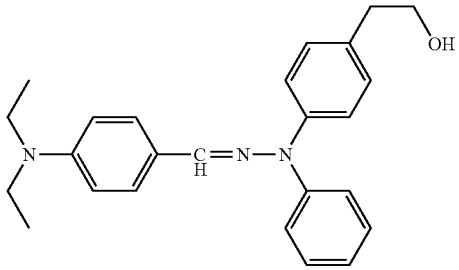

TABLE 8-continued
II-7
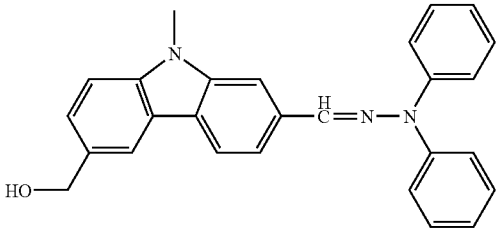
II-8
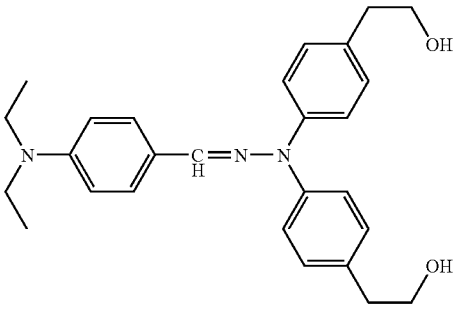
II-9
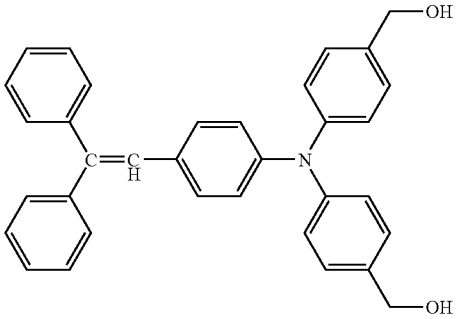
II-10
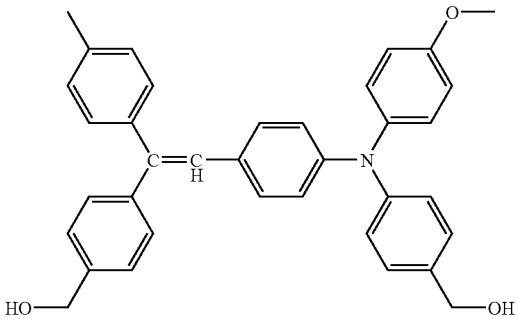
TABLE 9
III-1
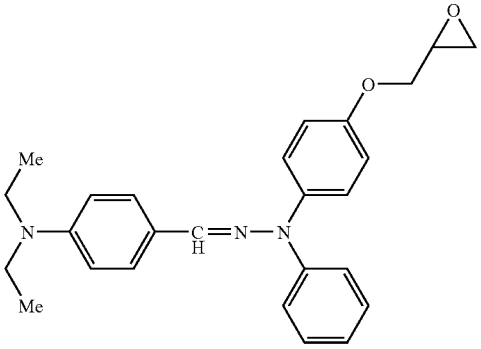
TABLE 9-continued
III-2
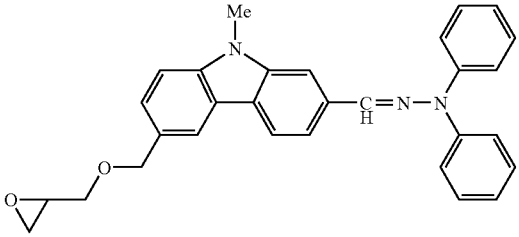
III-3
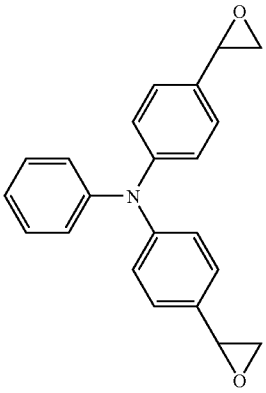
III-4
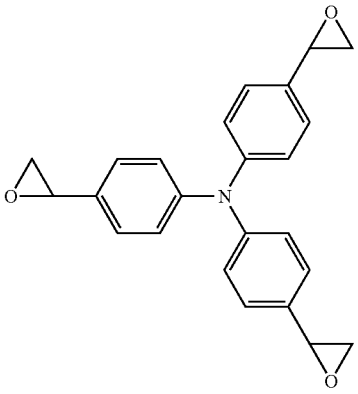
TABLE 10
III-5
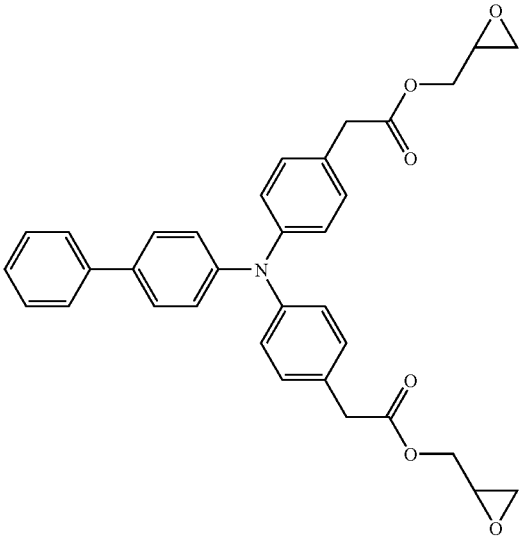

TABLE 11
IV-1
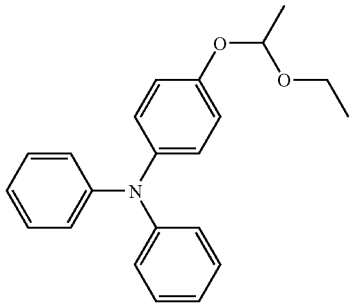
IV-2
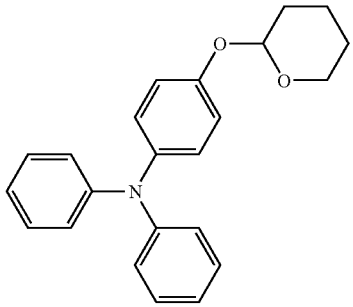
TABLE 12
IV-3
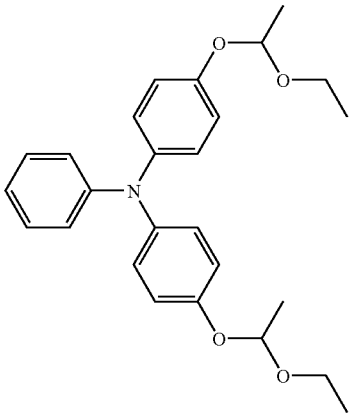
IV-4
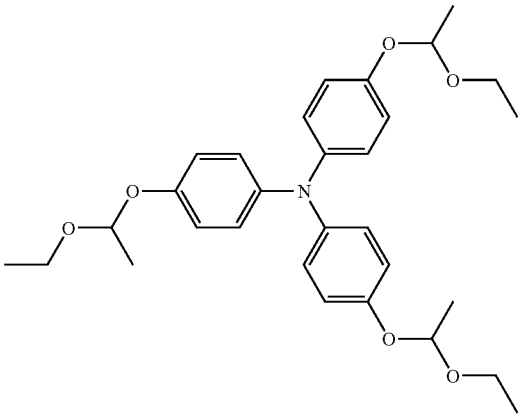
TABLE 12-continued
IV-5
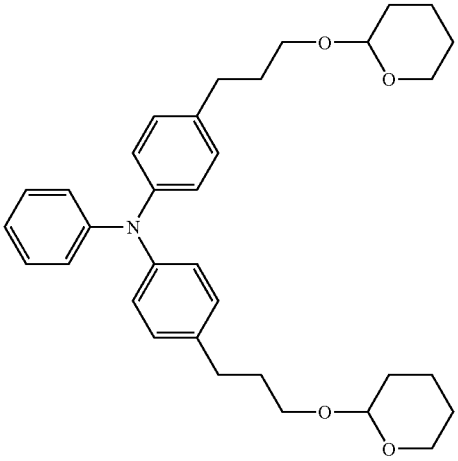
TABLE 13
V-1
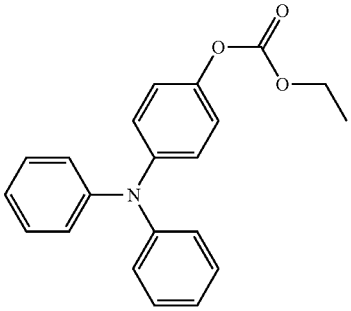
TABLE 14
V-2
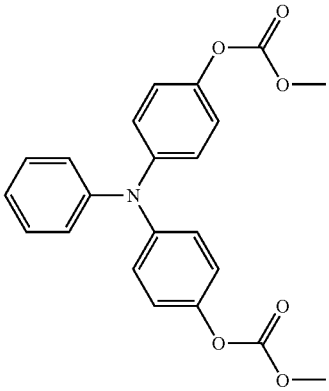
V-3
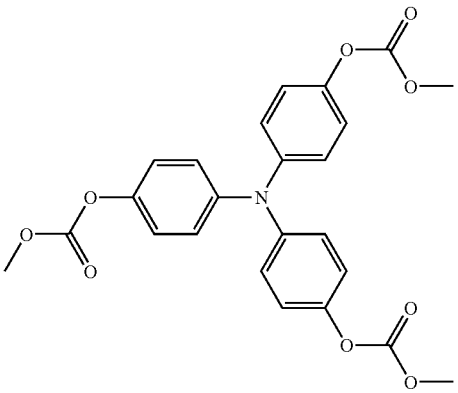

TABLE 14-continued
V-4
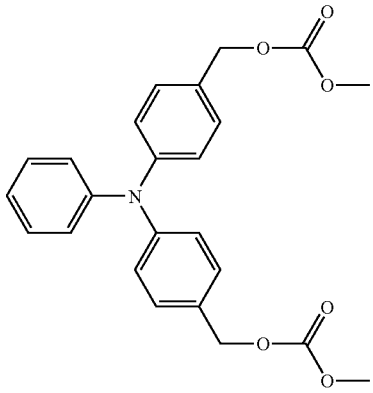
V-5
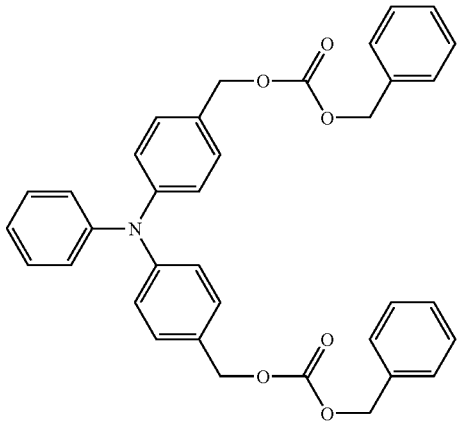
TABLE 15
VI-1
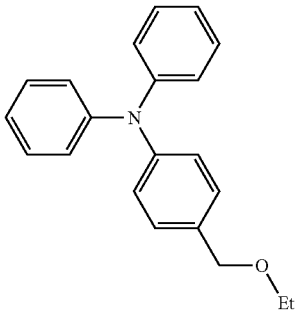
VI-2
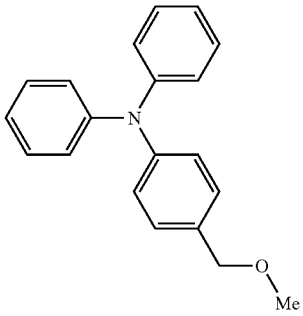
TABLE 15-continued
VI-3
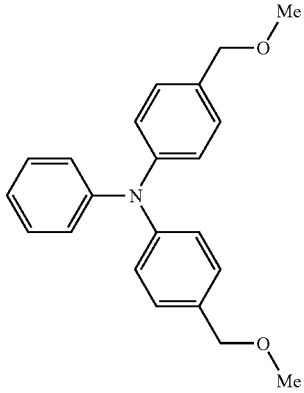
VI-4
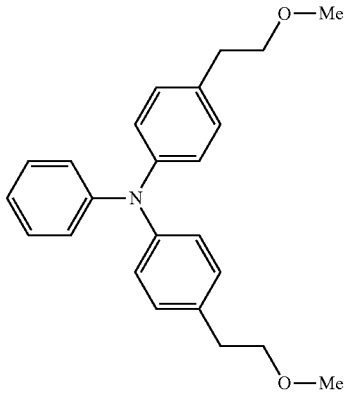
VI-5
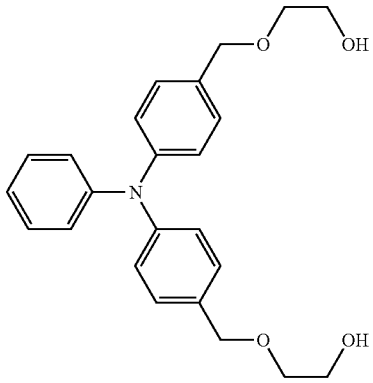
TABLE 16
VI-6
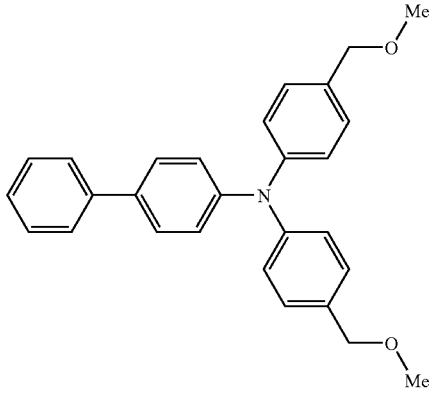

TABLE 16-continued
VI-7
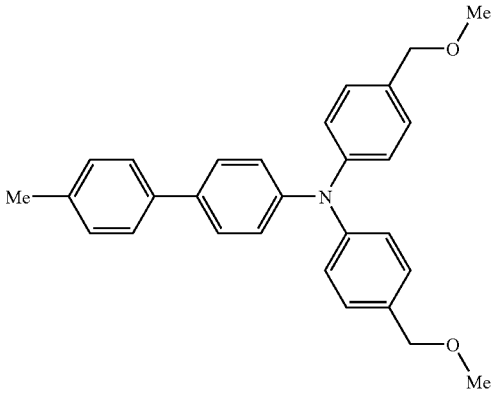
VI-8
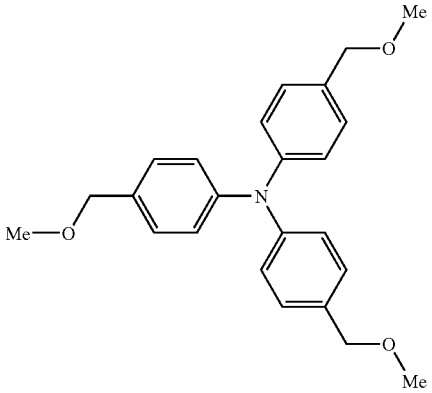
VI-9
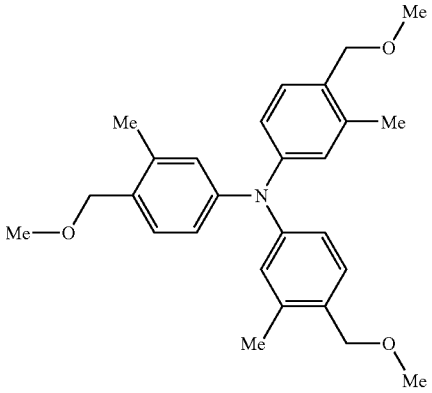
TABLE 17
VI-10
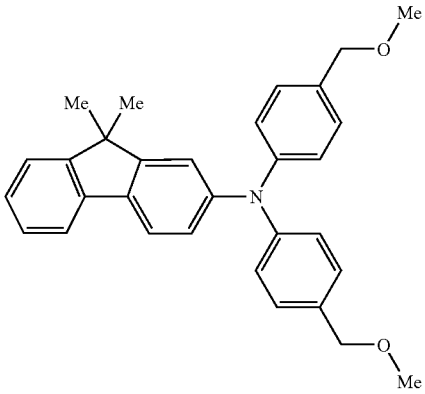
TABLE 17-continued
VI-11
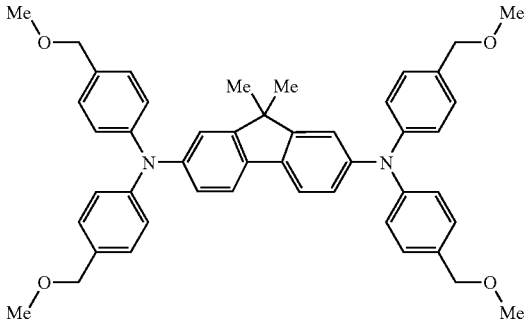
VI-12
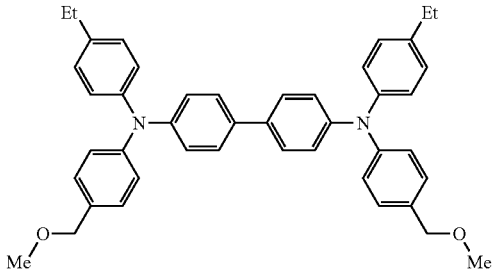
VI-13
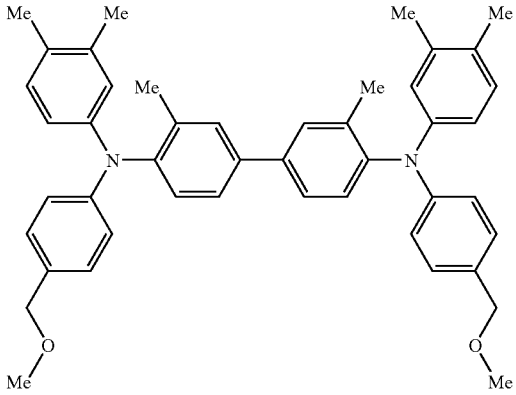
TABLE 18
VI-14
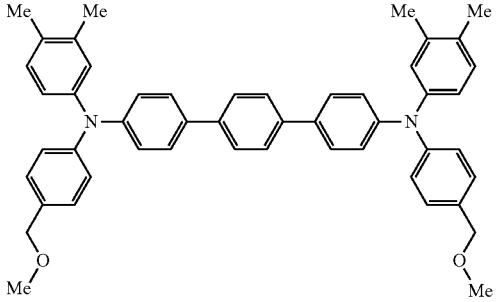

TABLE 18-continued

VI-15

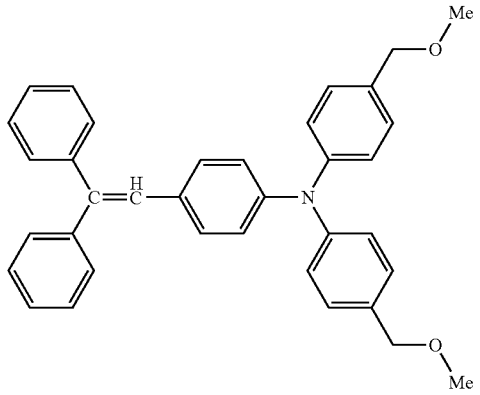

VI-16

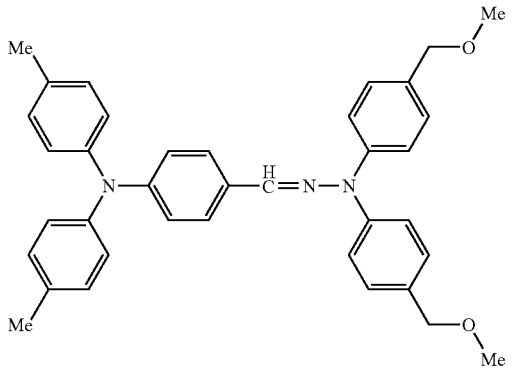

VI-17

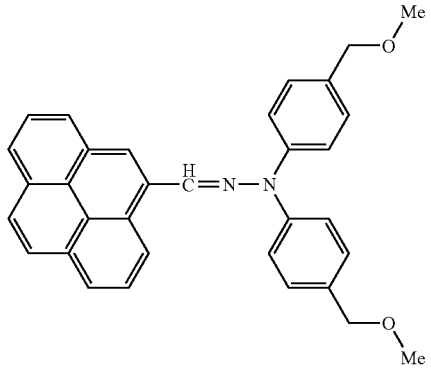

Examples of the phenol resin usable in the surface protective layer 16 include substituted phenols having one hydroxyl group such as resorcin, bisphenol, phenol, cresol, xylenol, a para-alkylphenol and para-phenylphenol; and substituted phenols having two hydroxyl groups such as catechol, resorcinol and hydroquinone; bisphenols such as bisphenol A and bisphenol Z; and bisphenols. Moreover, use can be made of resins which are obtained by reacting a compound having a phenol structure with formaldehyde, paraformaldehyde, etc. in the presence of an acid catalyst or an alkali catalyst and marketed in general as phenol resins. To further improve the abrasion resistance and the wear resistance, it is preferred that the phenol resin is a resol type phenol resin.

Further, the surface protective layer 16 may contain additives such as a plasticizer, a surface properties-improving agent, an antioxidant, a photo-deterioration-preventing agent and a hardening catalyst.

Examples of the plasticizer usable herein include biphenyl, biphenyl chloride, terphenyl, dibutyl phthalate, diethylene glycol phthalate, dioctyl phthalate, triphenyl phosphate, methylnaphthalene, benzophenone, chlorinated paraffin, polypropylene, polystyrene and various fluorohydrocarbons.

Use of an antioxidant is effective for improving potential stability upon environmental change and improving image qualities. It is possible to use an antioxidant having a partial structure of hindered phenol, hindered amine, thioether or phosphate. Specific examples of the hindered phenol-based antioxidation usable herein include 2,6-di-t-butyl-4-methylphenol, 2,5-di-t-butylhydroquinone, N,N'-hexamethylenebis(3,5-di-t-butyl-4-hydroxyhydrocinnamide, 3,5-di-t-butyl-4-hydroxy-benzylphosphonate-diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis(3-methyl-6-t-butylphenol).

Use of a hardening catalyst is effective in improving the scratch resistance and wear resistance of the surface protective layer. Examples thereof include alkaline earth metal oxides and alkaline earth metal hydroxides such as calcium hydroxide, barium hydroxide, magnesium oxide and magnesium hydroxide; alkali metal carbonate such as potassium carbonate, sodium hydrogen carbonate and sodium carbonate; inorganic acids such as hydrochloric acid and nitric acid; organic acids such as p-toluenesulfonic acid, phenolsulfonic acid, dodecylbenzenesulfonic acid and salicylic acid; and esters such as a phosphate, an organic ester, a formate and ethyl acetate.

The surface protective layer 16 may further contain an insulating resin such as a polyvinyl butyral resin, a polyarylate resin (for example, a polycondensation product of bisphenol A and phthalic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin and a polyvinylpyrrolidone resin. In this case, the insulating resin can be added at an arbitrary ratio. Thus, the adhesion between the photosensitive layers 12, 12' and 12" and coating film defects caused by thermal shrinkage or cissing can be inhibited.

The surface protective layer 16 may further contain a leveling agent such as silicone oil incorporated therein in order to improve the surface smoothness.

Examples of the silicone oil include silicone oils such as dimethyl polysiloxane, diphenyl polysiloxane and phenylmethyl siloxane; reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane; cyclic dimethyl cyclosiloxanes such as hexamethyl cyclotrisiloxane, octamethyl cyclotetrasiloxane, decamethyl cyclopentasiloxane and dodecamethyl cyclohexanesiloxane; cyclic methylphenyl cyclosiloxanes such as 1,3,5-trimethyl-1,3,5-triphenylcyclotrisiloxane, 1,3,5,7-tetramethyl-1,3,5,7-tetraphenylcyclotetrasiloxane and 1,3,5,7,9-pentamethyl-1,3,5,7,9-pentaphenylcyclopentasiloxane; cyclic phenyl cyclosiloxanes such as hexaphenylcyclotrisiloxane; fluorine-containing cyclosiloxanes such as 3-(3,3,3-trifluoropropyl)methyl cyclotrisiloxane; hydrosilyl group-containing cyclosiloxanes such as a methyl hydrosiloxane mixture, pentamethyl cyclopentasiloxane and phentylhydrocyclosiloxane; and vinyl group-containing cyclosiloxanes such as pentavinyl pentamethyl cyclopentasiloxane.

The surface protective layer is formed by preparing a coating solution for surface protective layer containing these components and coating the same. The coating solution for surface protective layer can be prepared by dissolving or dispersing these components in an appropriate solvent. Examples of the solvent usable herein include alcohol solvents such as methanol, ethanol, propanol and butanol; ketone solvents such as acetone and methyl ethyl ketone; and ethers such as tetrahydrofuran, diethyl ether and dioxane. A solvent having a boiling point not higher than 100° C. is preferable and use can be made of an arbitrary mixture thereof. Although the solvent may be used in an arbitrary amount, solid matters are liable to precipitate in the case of using the solvent in a too small amount. Thus, the amount of the solvent preferably ranges from 0.5 to 70 parts, more preferably from 1 to 60 parts, on the weight basis per part of the solid matters.

The surface protective layer 16 may further contain various additives such as a photo stabilizer and a heat stabilizer as stated with respect to the photosensitive layer. Specific examples and preferable examples of the additives usable herein are the same as stated with respect to the photosensitive layer.

Further, it is preferable that the surface protective layer 16 is treated with an aqueous dispersion containing a fluororesin as having been used in treating a cleaning blade member to reduce the torque as well as enhance the transferring efficiency.

The coating solution for surface protective layer thus prepared is coated on the surface of the photosensitive layer and dried to form the surface protective layer. The thickness of the surface protective layer is preferably from about 0.1 to about 100 μm.

As the coating method, there may be employed a common method such as a blade coating method, a Meyer bar coating method, a spray coating method, a dip coating method, a bead coating method, an air knife coating method or a curtain coating method.

Figure 4:
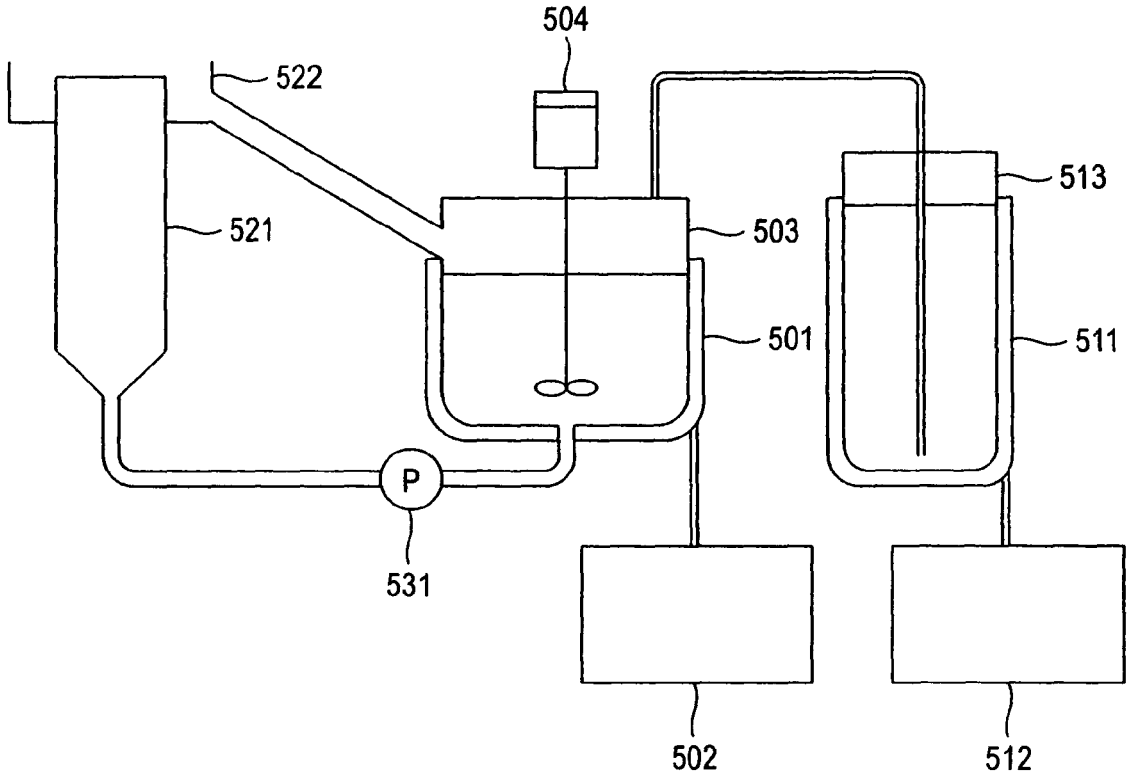
FIG. 4 is a schematic constitutional showing an exemplary embodiment of a dip coating device which is suitable in coating the surface protective layer.

FIG. 4 shows an exemplary embodiment of a dip coating device in the case of employing a dip coating method as the coating method. The coating device shown in FIG. 4 includes a dip coating tank 521, a flow receiver 522, a supplemental coating solution tank 513, a coating solution buffer tank 503, a circulation pump 531, an agitator 504 and a tank for a solvent for adjusting the viscosity of the coating solution (not shown).

Around the coating solution buffer tank 503 and the supplemental coating solution tank 513, jackets 501 and 511 are respectively provided and liquid temperature-controllers 502 and 512 are connected respectively to these jackets 501 and 511. Thus, the temperatures of the tanks 503 and 513 can be independently controlled. By controlling the temperature of the coating solution in the coating solution buffer tank 503, the temperature of the circulating coating solution in the dip coating tank 521 can be controlled.

As the temperature-controlling method to be used in the liquid temperature-controllers 502 and 512, use may be made of, for example, a method including optionally flowing cold or hot water in the jackets 501 and 511 or a method including providing cooling and/or electric heating coils within the jackets 501 and 511 and optionally driving the same.

A circulation pump 531 is provided in the pipe line connecting the coating solution buffer tank 503 to the dip coating tank 521 to transfer the coating solution from the former tank to the latter. On the other hand, the coating solution overflowing from the top opening of the dip coating tank 521 is collected by the flow receiver 522 and spontaneously returned to the coating solution buffer tank 503 via the pipe by gravitation. In this structure, therefore, the coating solution circulates between the coating solution buffer tank 503 and the dip coating tank 521.

The dip coating device having the above-described structure is filled with the coating solution for forming surface protective layer as a coating solution. While circulating the coating solution, a cylindrical pipe to be coated (i.e., an unfinished electrophotographic photoreceptor having been assembled till the photosensitive layer) is dipped in the dip coating tank 521 with locating the axis in the vertical direction. After a definite period of time, the pipe is drawn up at a definite speed. Thus, it is coated with the coating solution for forming surface protective layer. Next, the coating film is hardened by spontaneously drying or forced drying in, for example, an oven to thereby form the surface protective layer.

It is preferable that the coating solution in the supplemental coating solution tank 513 is cooled to a temperature lower than room temperature (for example, 24° C.) while the coating solution temperatures in the dip coating tank 521 and the coating solution buffer tank 503 are controlled to a level higher than the coating solution in the supplemental coating solution tank 513. By satisfying these temperature requirements, it is possible to prevent deterioration at the interface between the photosensitive layer (in particular, the charge transporting layer) and the surface protective layer, an increase in residual potential and the occurrence of defects such as a ghost image.

It is desirable that the temperature of the coating solution in the supplemental coating solution tank 513 is 20° C. or lower, more desirably not lower than the coagulation point of the coating solution and not hither than 10° C.

On the other hand, it is desirable that the temperature of the coating solution in the dip coating tank 521 is 20° C. or higher but not higher than 30° C., more desirably from 23° C. to 26° C.

<Surface Conditions of Conductive Support and Surface Protective Layer>

To produce an electrophotographic photoreceptor having a long life, excellent potential characteristics and sustaining properties and enabling to regulate deterioration in image qualities and ghost caused by interference, the present inventors have conducted studies under various conditions. In the course of these studies, they have found out a correlationship between the surface roughnesses of the conductive support and the surface protective layer serving as the outermost layer in an electrophotographic photoreceptor and the reflectivity of these surfaces and successfully established requirements for achieving the above-described object by appropriately controlling these factors, thereby completing the invention.

Accordingly, the electrophotographic photoreceptor of the invention is characterized by satisfying the following conditions (a) and (b):

$$3.6 \leqq (A+B)/C \times 100 \leqq 6 \quad \text{3. (a)}$$

$$B \leqq 0.3 \quad \text{(b)}$$

wherein A (μm) represents the ten-point-averaged surface roughness $R_{ZJIS94}$ of the conductive support, B (μm) represents the ten-point-averaged surface roughness $R_{ZJIS94}$ of the surface protective layer; and C (%) represents the reflectivity of the surface protective layer against the conductive support.

It is not clear why an electrophotographic photoreceptor having a long life, excellent potential characteristics and sustaining properties and enabling to regulate deterioration in image qualities and ghost caused by interference can be obtained by satisfying the above-described conditions (a) and (b). However, the effects thereof have been proved in practice by the tests conducted by the inventors (refer to Examples).

Concerning the above condition (a), the following condition (a') is preferable and the following condition (a") is more preferable.

$$4.5 \leqq (A+B)/C \times 100 \leqq 6 \quad \text{4. (a')}$$

$$5.4 \leqq (A+B)/C \times 100 \leqq 6 \quad \text{5. (a")}$$

Concerning the above condition (b), on the other hand, the following condition (b') is preferable.

$$B \leqq 0.25 \quad \text{(b')}$$

In the invention, the surface roughness to be measured in the above-described conductive support and surface protective layer is A (μm) expressed in ten-point-averaged surface roughness $R_{ZJIS94}$. The term "ten-point-averaged surface roughness $R_{ZJIS94}$" as used herein is the one defined in JIS B0601 (2001) "Geometrical Product Specifications (GPS)—Surface Texture; Profile Method—Terms, Definitions and Surface Texture Parameters", Appendix 1 and has the same meaning as a ten-point-averaged surface roughness $R_z$ officially defined in JIS B0601 (1994).

Although the measurement is made at a cut-off value $\lambda_c$ of 0.8 mm and an evaluation length of 10 mm, the invention is not restricted thereto. That is, any conditions may be appropriately selected so long as falling within the definition by JIS B0601 (2001) Appendix 1.

The method of measuring ten-point-averaged surface roughness $R_{ZJIS94}$ is not particularly restricted and it can be easily measured by using a measurement device in accordance with the JIS criteria (1994). More specifically speaking, use can be made of, for example, a marketed device of SURFCOM 1400 Series (manufactured by Tokyo Seimitsu Co., Ltd.).

Concerning the conductive support, the ten-point-averaged surface roughness $R_{ZJIS94}$ of the outer circumference immediately before the formation of the intermediate layer is measured.

Concerning the surface protective layer, the ten-point-averaged surface roughness $R_{ZJIS94}$ of the outer circumference of the finished electrophotographic photoreceptor is measured.

In the invention, the reflectivity of the surface protective layer against the conductive support means a value determined as follows.

The surface of the subject to be measured is irradiated with light of 780 nm in wavelength at the right angle to the front. Then the normal reflected light thus rebounding is measured. Similar to ten-point-averaged surface roughness $R_{ZJIS94}$ the subjects to be measured are the surface of the conductive support before the formation of the intermediate layer and the surface of the surface protective layer, i.e., the outermost surface of the finished electrophotographic photoreceptor. By referring the reflectivity of the normal reflected light from the conductive support as to 100%, the percentage (%) of the reflectivity of the normal reflected light from the surface protective layer is defined as "the reflectivity of the surface protective layer against the conductive support" in the invention.

In determining the reflectivity, the normal reflected light may be measured by using a publicly known device for measuring reflectivity without specific restriction. More specifically speaking, the measurement can be made by using a marketed device such as an instantaneous multi-wavelength spectrophotometer MCPD-3000 (manufactured by Otsuka Electronics).

In measuring ten-point-averaged surface roughness $R_{ZJIS94}$ or reflectivity of, for example, a cylindrical electrophotographic photoreceptor, measurement is made each at 4 positions with center angle of 90° in the peripheral direction respectively along the central axial direction and the both side peripheral directions (for example, 5 cm to 10 cm apart from the edge of the area to be used as a photoreceptor), namely, 12 points in total. Then, the mean is calculated and referred to as the ten-point-averaged surface roughness $R_{ZJIS94}$ or reflectivity. Although the location and number of the measurement points are not restricted, a value with little measurement error can be obtained by measuring at the 12 points as described above.

<Control of Surface Conditions>

The ten-point-averaged surface roughness $R_{ZJIS94}$ of the conductive support as described above can be controlled by, for example, regulating the conditions in producing the starting uncoated pipe, willingly controlling the surface conditions by, for example, a wet-horning treatment or a centerless grinding treatment, or conducting a surface treatment such as an anodic oxidation.

On the other hand, the ten-point-averaged surface roughness $R_{ZJIS94}$ of the surface protective layer as described above can be controlled by, for example, appropriately regulating the coating conditions (various conditions depending on the coating method employed, for example, the composition, temperature and concentration of the coating solution, the humidity in the coating environment, the coating method, the coating time and the draw-up speed in the case of the dip coating). It is also possible to pattern (including to grind) the surface protective layer surface after the formation thereof. In this case, it is preferable to grind the surface of the surface protective layer to give a desired surface conditions, since this method is more convenient than regular patterning.

As the method of grinding the outermost face of the electrophotographic photoreceptor, use can be made of a publicly known method without restriction. For example, it is possible to employ any grinding method such as a wet horning method, a shot blasting method, a buff grinding method, a laser shot method, a barrel grinding method, or sandpaper- or wrapping tape-grinding, so long as the surface shape as defined in the invention can be thus obtained.

The reflectivity of the surface protective layer to the conductive support can be controlled by, for example, adding a filler to the surface protective layer while regulating the particle diameter of the filler and the filler amount, or appropriately selecting various conditions such as the thickness of the surface protective layer and the solvent for the coating solution.

[Image Forming Apparatus According to the Invention]

The image forming apparatus according to the invention includes at least the electrophotographic photoreceptor according to the invention, a charging unit that charges the surface of the electrophotographic photoreceptor, an exposing unit that imagewise exposes the surface of the electrophotographic photoreceptor to form a latent image, a developing unit that feeds a toner to the surface of the electrophotographic photoreceptor and thus develops the latent image to form a toner image, and a transferring unit that transfers the developed toner image to a transfer medium. If necessary, it further includes a fixing unit that fixes the transferred toner image, a cleaning unit that cleans the toner remaining on the electrophotographic photoreceptor surface after the transfer, a statically eliminating unit that removes the residual charge on the electrophotographic photoreceptor surface after the cleaning, and other various units and mechanisms of the electrophotographic system.

The subject to be transferred by the transferring unit may be either a recording medium such as paper or an OHP sheet or an intermediate transfer body such as an intermediate transfer belt. In the case of transferring to an intermediate transfer body (the intermediate transfer system), the image can be secondarily transferred to a recording medium to thereby form an image on the surface of the recording medium.

In this process, a color image can be formed by laminating images in two or more colors on the surface of the intermediate transfer body and then secondarily transferring these images at once to the recording medium. By forming images in three or four colors, it is also possible to form a full-color image.

Figure 5:
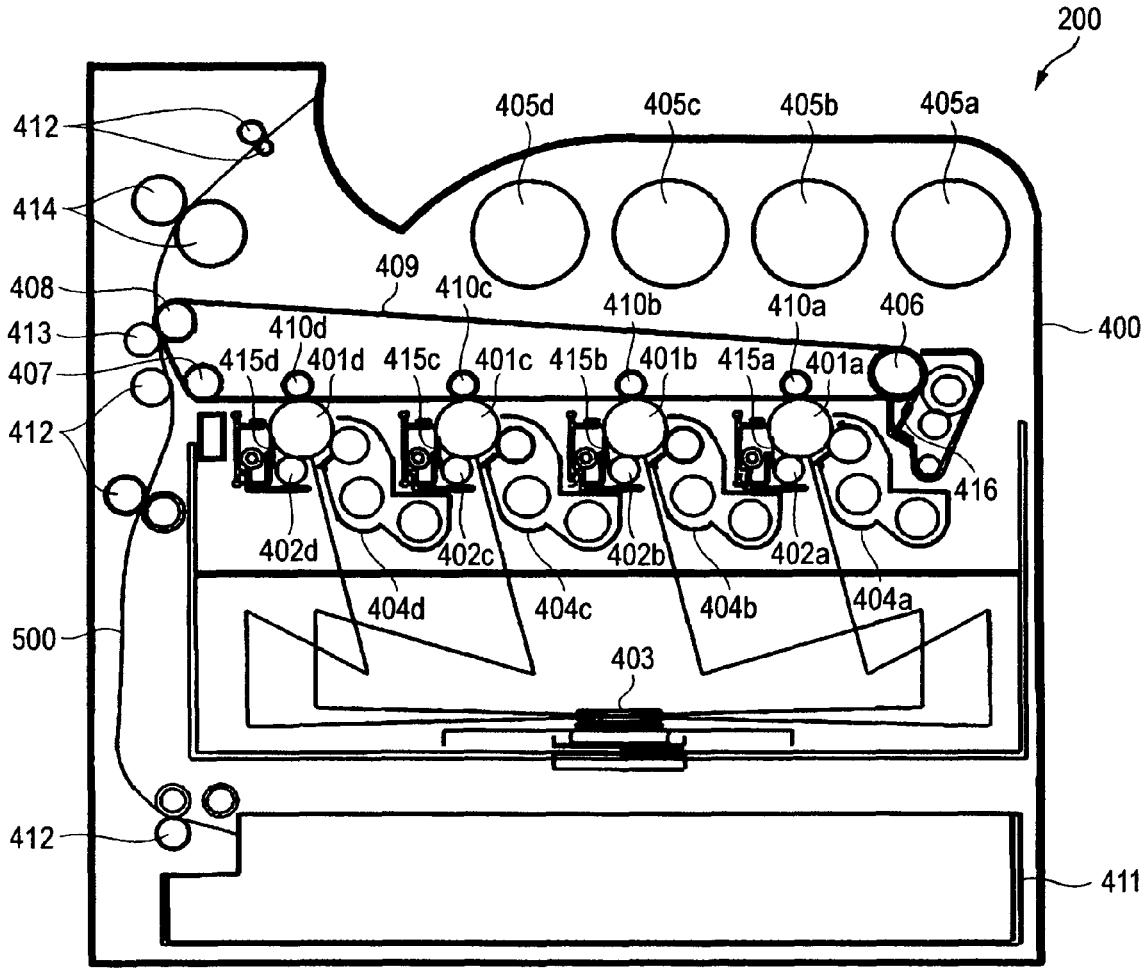
FIG. 5 is a typical sectional view schematically showing an exemplary embodiment of the image forming apparatus according to an aspect of the invention.

FIG. 5 is a typical sectional view schematically showing a preferable exemplary embodiment of the image forming apparatus according to the invention.

The image forming apparatus 200 shown in FIG. 5 is an image forming apparatus that has charging devices (charging units) 402*a* to 402*d* of the contact charging mode, employs the intermediate transfer mode for the transfer and includes a plural number image forming units each having at least the charging devices 402*a* to 402*d*, an exposing device (exposing unit) 403 and developing devices (developing units) 404*a* to 404*d*, i.e., an image forming apparatus of the so-called tandem system.

More specifically speaking, in a housing 400 of this image forming apparatus 200 of the tandem system, 4 photoreceptors (electrophotographic photoreceptors) 401*a* to 401*d* (for example, the photoreceptors 401*a*, 401*b*, 401*c* and 401*d* are respectively capable of forming a yellow image, a magenta image, a cyan image and a black image) are provided in parallel along an intermediate transfer belt 409. The photoreceptors 401*a* to 401*d* loaded on the image forming apparatus 200 are each the electrophotographic photoreceptor according to the invention as described above.

The image forming apparatus 200 further includes cleaning devices (cleaning units) 415*a* to 415*d*.

The photoreceptors 401*a* to 401*d* are each rotatable in a definite direction (the counterclockwise direction on the paper face in FIG. 5). Along the rotational direction, there are provided roller-type charging devices 402*a* to 402*d* (contact charging devices that charge the electrophotographic photoreceptor), developing devices 404*a* to 404*d* (the development units developing an electrostatic latent image formed by the exposing device to form a toner image), transferring devices 410*a* to 410*d* (transferring units in the form of primary transferring rollers for primarily transferring the toner image formed by the developing units to the intermediate transfer belt 409 (intermediate transfer body) as will be described hereinafter), and cleaning devices 415*a* to 415*d* (cleaning units of the blade cleaning system).

Toner cartridges 405*a* to 405*b* are provided so that toners in 4 colors (yellow, magenta, cyan and black) can be fed respectively to the developing devices 404*a* to 404*d*. The transferring devices 410*a* to 410*d* are in contact respectively with the photoreceptors 401*a* to 401*d* via the intermediate transfer belt 409 (the intermediate transfer body for transferring the primary transfer image to the transfer medium 500).

Moreover, an exposing device 403 (an exposing unit that exposes the electrophotographic photoreceptor having been charged by the charging device to form an electrostatic latent image) serving as a laser light source is located at a definite position in the housing 400. The apparatus is constituted to that the laser light generated from the exposing device 403 irradiates the surface of the photoreceptors 401*a* to 401*d* having been charged by the charging device 402*a* to 402*d* but not yet developed by the developing devices 404*a* to 404*d*.

Thus, the charging, exposing, developing, primary transferring and cleaning steps are successively conducted as the photoreceptors 401*a* to 401*d* rotate and the toner images in the individual colors are transferred in the overlapping state to the surface (the outer circumferential face) of the intermediate transfer belt 409.

The charging devices (charging units) 402*a* to 402*d*, which are in the shape of roller, evenly apply voltage to the photoreceptors 401*a* to 401*d* and thus charge the surface of the photoreceptors 401*a* to 401*d* at a definite potential. As the material of the charging devices 402*a* to 402*d*, use may be made of, for example, a metal such as aluminum, iron or copper; a conductive polymer material such as polyacetylene, polypyrrole or polythiophene; or an elastomer material such as a polyurethane rubber, a silicone rubber, an epichlorohydrin rubber, an ethylene propylene rubber, an acrylic rubber, a fluorinated rubber, a styrene-butadiene rubber or a butadiene rubber, in which particles of carbon black, copper iodide, silver iodide, zinc sulfide, silicon carbide or a metal oxide are dispersed.

Examples of the metal oxide include ZnO, $SnO_2$, $TiO_2$, $In_2O_3$, $MoO_3$ and a complex oxide thereof. It is also possible to use an elastomer material having conductivity imparted by adding a perchlorate as the charging devices 402*a* to 402*d*.

Furthermore, the charging devices 402*a* to 402*d* may have a coating layer on the surface thereof. As the material for forming the coating layer, use can be made of an N-alkoxymethylated nylon, a cellulose resin, a vinyl pyridine resin, a phenol resin, polyurethane, polyvinyl butyral or melamine either singly or combinedly. It is also possible to use an emulsion resin-based material such as an acrylic resin emulsion, a polyester resin emulsion or polyurethane. Among all, an emulsion resin synthesized by soap-free emulsion polymerization is preferable.

Such a resin may further contain conductive particles dispersed therein for controlling the resistivity or an antioxidant for preventing oxidation. It is also possible to add a leveling agent or a surfactant to the resin to thereby improve the film-forming properties in forming the coating layer. Although roller-shaped charging devices 402*a* to 402*d* of the contact charging type are cited herein by way of example, the shape thereof is not restricted in the invention. That is, use can be made of, for example, blade-shaped, belt-shaped or brush-shaped devices therefor.

The electrical resistivities of the charging devices 402*a* to 402*d* preferably ranges from $10^2$ to $10^{14}$ Ωcm, more preferably from $10^2$ to $10^{12}$ Ωcm. The application voltage to the contact type charging members may be either a direct current or an alternate current, or a direct current+an alternate current (a direct current superimposed by an alternate current).

Although contact charging type transferring devices 410*a* to 410*d* are cited herein by way of example, the invention is not restricted thereto. Namely, use may be made of scorotron charging type transferring devices or corotron charging type transferring devices.

As the developing devices 904*a* to 404*d*, use can be made of publicly known developing devices using a normal or reversed developing agent of the monocomponent or dicomponent type. From the viewpoint of improving the image qualities, it is particularly preferable to employ the dicomponent development system with the use of a dicomponent developing agent. In this case, a developing agent (a dicomponent developing agent) to be used for visualizing an electrostatic latent image consists of a toner and a carrier.

The toner to be used herein is not particularly restricted. For example, it is appropriate to use an amorphous toner prepared by the milling method or a spherical toner prepared by the polymerization method.

The cleaning devices 415*a* to 415*d* are employed for removing the residual toner sticking to the surface of the photoreceptors 401*a* to 401*d* after the primary transfer. Thus, the surface of the photoreceptors 401*a* to 401*d* can be cleansed and repeatedly used in the subsequent image forming process.

As the cleaning devices 415*a* to 415*d*, it is possible to use cleaning blades, cleaning brushes, cleaning rollers and so on. Among them, it is preferable to use cleaning blades as herein. Examples of the material of the cleaning blades include a urethane rubber, a neoprene rubber and a silicone rubber.

The intermediate transfer belt 409 is an endless belt made of a publicly known material such as polyamide, polyimide or polyamideimide. An intermediate transfer belt made of polyimide can be produced by, for example, the following procedure.

Namely, a polyamidic acid solution is obtained by polymerizing nearly equal moles of a tetracarboxylic dianhydride or a derivative thereof with a diamine in a definite solvent. Next, this polyamidic acid solution is fed and spread onto a cylindrical mold to form a film (a layer) followed by imidation. Thus, an intermediate transfer belt 409 made of a polyimide resin can be obtained.

Examples of the tetracarboxylic dianhydride include pyromellitic acid dianhydride, 3,3',4,4'-benzophenone tetracarboxylic dianhydride, 3,3',4,4'-biphenyl tetracarboxylic dianhydride, 2,3,3',4-biphenyl tetracarboxylic dianhydride, 2,3,6,7-naphthalene tetracarboxylic dianhydride, 1,2,5,6-naphthalene tetracarboxylic dianhydride 1,4,5,8-naphthalene tetracarboxylic dianhydride, 2,2'-bis(3,4-dicarboxyphenyl) sulfonic dianhydride, perylene-3,4,9,10-tetracarboxylic dianhydride, bis(3,4-dicarboxyphenol)ether dianhydride and ethylene tetracarboxylic dianhydride.

Specific examples of the diamine include 4,4'-diaminodiphenyl ether, 4,4'-diaminodiphenyl methane, 3,3'-diaminodiphenyl methane, 3,3'-dichlorobenzidine, 4,4'-diaminodiphenyl sulfide, 3,3'-diaminodiphenyl sulfone, 1,5-diaminonaphthalene, m-phenylene diamine, p-phenylene diamine, 3,3'-dimethyl-4,4'-biphenyl diamine, benzidine, 3,3'-dimethyl benzidine, 3,3'-dimethoxy benzidine, 4,4'-diaminophenyl sulfone, 4,4'-diaminodiphenyl propane, 2,4-bis (β-amino-tertiary butyl)toluene, bis(p-β-amino-tertiary butyl phenyl)ether, bis(p-β-methyl-δ-aminophenyl)benzene, bis-p-(1,1-dimethyl-5-aminopentyl)benzene, 1-isopropyl-2,4-m-phenylene diamine, m-xylylene diamine, p-xylylene diamine, di(p-aminocyclohexyl)methane, hexamethylene diamine, heptamethylene diamine, octamethylene diamine, nonamethylene diamine, decamethylene diamine, diaminopropyl tetramethylene diamine, 3-methyl heptamethylene diamine, 4,4-dimethylheptamethylene diamine, 2,11-diaminododecane, 1,2-bis-3-aminopropoxy ethane, 2,2-dimethyl propylene diamine, 3-methoxyhexamethylene diamine, 2,5-dimethylheptamethylene diamine, 3-methyl heptamethylene diamine, 5-methyl nonamethylene diamine, 2,17-diamino eicosadecane, 1,4-diaminocyclohexane, 1,10-diamino-1,10-dimethyl decane, 1,2-diamino octadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$ and $H_2N(CH_2)_3N(CH_2)_3(CH_2)_3NH_2$.

As the solvent to be used for the polymerization of the tetracarboxylic dianhydride with the diamine, a polar solvent is preferable from the view point of solubility. As the polar solvent, N,N-dialkyl amides are preferred. In particular, polar solvents having lower molecular weight are preferable and examples thereof include N,N-dimethyl formamide, N,N-dimethyl acetamide, N,N-diethyl formamide, N,N-diethyl acetamide, N,N-dimethylmethoxy actamide, dimethyl sulfoxide, hexamethyl phosphoryl triamide, N-methyl-2-pyrrolidone, pyridine, tetramethylene sulfone and dimethyltetramethylene sulfone. These solvents may be employed either singly or combinedly.

To control the film resistivity of the intermediate transfer belt 409, carbon may be dispersed in the polyimide resin. Although the kind of the carbon is not restricted, it is preferable to use oxidized carbon black having an oxygen-containing functional group (for example, a carboxyl group, a quinone group, a lactone group or a hydroxyl group) formed on the surface during oxidation of carbon black. In the case of dispersing oxidized carbon black in the polyimide resin, an excessive current flows in the oxidized carbon black upon the application of voltage. Thus, the polyimide resin is less affected by oxidation caused by repeated voltage application. Since the oxidized carbon black is highly dispersible in the polyimide resin owing to the oxygen-containing functional group formed on the surface thereof, moreover, it contributes to the reduction of scattering in resistivity and to the reduction of electrical field-dependency. As a result, the frequency of the occurrence of electrical field concentration by the transfer voltage is lowered. Thus, it becomes possible to prevent a decrease in the resistivity caused by the transfer voltage, to improve the electrical resistivity evenness and to obtain an intermediate transfer belt that less depends on electrical field, shows little environmental change in the resistivity and ensures excellent image qualities with regulated image defects such as pinholes in a running part of paper.

The oxidized carbon black can be obtained by oxidizing carbon black by an air oxidation method of contact reaction with air in high temperature atmosphere, a reaction method of nitrogen oxide or ozone at ordinary temperature, or a method of oxidation by ozone at low temperature after air oxidation at high temperature.

As the oxidized carbon black, use can be made of marketed produces such as MA100 (pH 3.5, volatile matter content 1.5% (by weight, the same will apply hereinafter)), MA100R (pH 3.5, votalile matter content 1.5%), MA100S (pH 3.5, votalile matter content 1.5%), #970 (pH 3.5, votalile matter content 3.0%), MA11 (pH 3.5, votalile matter content 2.0%), #1000 (pH 3.5, votalile matter content 3.0%), #2200 (pH 3.5, votalile matter content 3.5%), MA230 (pH 3.0, votalile matter content 1.5%), MA220 (pH 3.0, votalile matter content 1.0%), #2650 (pH 3.0, votalile matter content 8.0%), MA7 (pH 3.0, votalile matter content 3.0%), MA8 (pH 3.0, votalile matter content 3.0%), OIL 7B (pH 3.0, votalile matter content 6.0%), MA77 (pH 2.5, votalile matter content 3.0%), #2350 (pH 2.5, votalile matter content 7.5%), #2700 (pH 2.5, votalile matter content 10.0%) and #2400 (pH 2.5, votalile matter content 9.0%) each manufactured by Mitsubishi Chemical; PRINTEX 150T (pH 4.5, votalile matter content 10.0%), SPECIAL BLACK 350 (pH 3.5, votalile matter content 2.2%), SPECIAL BLACK 100 (pH 3.3, votalile matter content 2.2%), SPECIAL BLACK 250 (pH 3.1, votalile matter content 2.0%), SPECIAL BLACK 5 (pH 3.0, votalile matter content 15.0%), SPECIAL BLACK 4 (pH 3.0, votalile matter content 14.0%), SPECIAL BLACK 4A (pH 3.0, votalile matter content 14.0%), SPECIAL BLACK 550 (pH 2.8, votalile matter content 2.5%), SPECIAL BLACK 6 (pH 2.5, votalile matter content 18.0%), COLOR BLACK FW200 (pH 2.5, votalile matter content 20.0%), COLOR BLACK FW2 (pH 2.5, votalile matter content 16.5%) and COLOR BLACK FW2V (pH 2.5, votalile matter content 16.5%) each manufactured by Degussa; MONARCH 1000 (pH 2.5, votalile matter content 9.5%), MONARCH 1300 (pH 2-5, votalile matter content 9.5%), MONARCH 1400 (pH 2.5, votalile matter content 9.0%), MOGUL-L (pH 2.5, votalile matter content 5.0%), and REGAL 400R (pH 4.0, votalile matter content 3.5%) each manufactured by Cabot Corp. It is preferable to use an oxidized carbon black having a pH value of 4.5 or lower and a volatile matter content of 1.0% or more.

The conductivities of these oxidized carbon blacks differ depending on, for example, oxidation extent, DBP oil absorption, physical properties such as specific surface area determined by the BET method with the use of nitrogen adsorption and so on. Although these oxidized carbon blacks may be used either singly or combinedly, it is preferable to combine two or more oxidized carbon blacks having substantially different conductivities. In the case of using a combination of two or more carbon blacks having different physical properties, the surface resistivity can be controlled by, for example, preferentially adding a carbon black showing a higher conductivity and then adding another carbon black showing a lower conductivity.

The content of the oxidized carbon black is preferably from 10 to 50% by weight, more preferably from 12 to 30% by weight, based on the polyimide resin. When the content thereof is less than 10% by weight, it is sometimes observed that the evenness in electrical resistivity is lowered and the surface resistivity is largely lowered during prolonged use. On the other hand, it is undesirable that the extent thereof exceeds 50% by weight, since the desired resistivity can be hardly achieved and a molded article obtained thereform becomes fragile in this case.

As a method of producing a polyamidic acid solution having two or more kinds of oxidized carbon blacks dispersed therein, there can be enumerated a method which includes preliminarily dispersing two or more kinds of oxidized carbon blacks in a solvent and then dissolving the acid dianhydride component and the diamine as described above in the dispersion followed by polymerization, a method which includes dispersing two or more kinds of oxidized carbon blacks respectively in solvents to give two or more kinds of carbon black dispersions, dissolving the acid dianhydride component and the diamine as described above in these dispersions and then mixing these polyamic acid solutions, and so on.

The intermediate transfer belt 409 can be obtained by feeding and spreading the thus obtained polyamidic acid solution onto the inner face of a cylindrical mold to form a coating film and then imidating the polyamidic acid by heating. By maintaining the film at a definite temperature for 0.5 hour or longer in this imidation step, an intermediate transfer belt having a high smoothness can be obtained.

Examples of the method of feeding the polyamidic acid solution onto the inner face of the cylindrical mold include a method using a dispenser and a method using a dice. As the cylindrical mold, it is preferable to use one having a mirror finished inner circumferential face.

Examples of the method of forming a film from the polyamidic acid solution fed to the inner face of the cylindrical mold include a method of centrifugally forming a film under heating, a method of forming a film with the use of a bullet-shaped running member and a method of rotationally forming a film. By employing such a method, a coating film having a more even thickness can be formed.

Examples of the method of forming an intermediate transfer belt via the imidation of the coating film thus formed include: (i) a method including putting the coating film together with the mold into a dryer and heating it to the reaction temperature of the imidation; and (ii) a method including removing the solvent to such an extent as allowing the shape retention as a belt, peeling off the coating film from the inner face of the mold, putting it on the outer circumferential face of a metallic cylinder, and heating the film together with the cylinder to thereby conduct the imidation. Although the imidation can be conducted either one of the above methods (i) and (ii) so long as the dynamic hardness of the surface of the obtained intermediate transfer belt satisfies the conditions as described above, the method (ii) is preferred. This is because the imidation by the method (ii) ensures efficient production of an intermediate transfer body having a high planarity and an excellent outer surface accuracy. Next, the method (ii) will be described in detail.

Although the heating conditions for removing the solvent in the method (ii) are not particularly restricted so long as the solvent can be removed, it is preferable that the heating temperature is 80 to 200° C. and the heating time is 0.5 to 5 hours. The molded article, which has been thus made to retain its shape as a belt, is peeled off from the inner circumferential face of the mold. In this peeling step, the inner circumferential face of the mold may be subjected to a mold releasing treatment.

Next, the molded article, which has been heated and hardened to retain its shape as a belt, is put on the outer circumferential face of a metallic cylinder and then heated together with the cylinder to thereby proceed the imidation of the polyamidic acid. As the metallic cylinder, use is preferably made of one having a larger linear expansion coefficient than the polyimide resin. By making the outer diameter of the cylinder smaller by a definite level than the inner diameter of the molded polyimide article, heat setting can be conducted so that an endless belt having an even thickness without irregularity can be obtained.

It is preferable that the arithmetic mean roughness Ra of the outer circumferential face of the metallic cylinder is from 1.2 to 2.0 μm. When the arithmetic mean roughness Ra of the outer circumferential face of the metallic cylinder is less than 1.2 μm, the metallic cylinder per se is too smooth and thus the obtained intermediate transfer belt undergoes no slippage due to the contraction in the axial direction of the belt. As a result, there arises a tendency that the film thickness becomes uneven or the planarity accuracy is lowered in stretching conducted in this step. When the arithmetic mean roughness Ra of the outer circumferential face of the metallic cylinder exceeds 2.0 μm, there arises a tendency that the outer face of the metallic cylinder is transferred to the inner face of the belt-shaped intermediate transfer body and small peaks and valleys are formed on the outer face, thereby inducing the occurrence of image defects. The arithmetic mean roughness Ra as described in the present exemplary embodiment means a value measured in accordance with JIS B0601.

At the imidation, the heating temperature is preferably form 220 to 280° C. while the heating time is preferably form 0.5 to 2 hours, though the heating conditions depend on the composition of the polyimide resin. When the imidation is carried out under such heating conditions, the contraction ratio of the polyimide resin is elevated. By slowly contracting the belt in the axial direction, therefore, unevenness in thickness and lowering in planarity accuracy can be prevented.

It is preferable that the arithmetic mean roughness Ra of the outer circumferential face of the intermediate transfer belt made of the polyimide resin thus obtained is 1.5 μm or less. When the arithmetic mean roughness Ra of the outer circumferential face of the intermediate transfer belt exceeds 1.5 μm, image defects such as coarseness frequently occur. It is considered that such coarseness occurs as follows. Namely, the voltage applied at the transfer or the electrical field caused by the peeling discharge topically concentrates on peaks on the belt surface and thus the peak surface is denatured. As a result, a new conductive pathway appears and thus the resistivity is lowered, which causes a decrease in the density of the obtained image.

The intermediate transfer belt 409 thus obtained is preferably a seamless belt. In the case of a seamless belt, the thickness of the intermediate transfer belt 409 may be appropriately determined depending on the purpose of use. From the viewpoints of mechanical characteristics such as strength and flexibility, the thickness is preferably from 20 to 500 μm, more preferably from 50 to 200 μm.

Concerning the surface resistance of the intermediate transfer belt 409, it is preferable that the common logarithmic value of its surface resistivity (Ω/□) is from 8 to 15 (log Ω/□), more preferably from 11 to 13 (log Ω/□). The surface resistivity as described herein means a value obtained by applying a 100 V voltage in the environment of 22° C. and 55% RH and measuring the current value 10 seconds later. The term "surface resistivity (Ω/□)" as used herein has the same meaning as "surface resistivity" described in Hakumaku Hando Bukku, Ohmsha, p. 896. That is, it means resistance between two facing sides of a quadrate cut out from a planar resistant body. So long as the resistance is evenly distributed, the surface resistivity remains constant regardless of the quadrate size.

The intermediate transfer belt 409 is supported by a driving roller 406, a backup roller 408 and a tension roller 407 at a definite tension and can rotate without deflection owing to the rotation of these rollers.

A secondary transfer roller 413 is provided in contact with the backup roller 408 via the intermediate transfer belt 409. The intermediate transfer belt 409 having passed between the backup roller 408 and the secondary transfer roller 413 is cleansed by a cleaning blade 416 and then repeatedly fed into the subsequent image forming process.

A tray (a transfer medium tray) 411 is provided at a definite position in the housing 400. A transfer medium 500 such as paper in the tray 411 is conveyed by a convey roller 412 successively to the space between the intermediate transfer belt 409 and the secondary transfer roller 413 and the space between two rollers contacting together of a fixing device (fixing unit) 414 and then discharged from the housing 400.

As described above, the changing, exposing, developing, transferring and cleaning steps are successively conducted with the rotation of the photoreceptors 401*a* to 401*d* and thus image formation is repeatedly conducted. The photoreceptors 401*a* to 401*d* are the electrophotographic photoreceptor 1 as described above and, therefore, have the excellent functions and effects according to the invention. Thus, these photoreceptors per se have long life and excellent electrical and sustaining characteristics and enable the achievement of favorable image qualities while preventing deterioration in image qualities and ghost image formation caused by interference.

The image forming apparatus of the invention is not restricted to the apparatus of the present exemplary embodiment. For example, the apparatus shown in FIG. 5 may have a process cartridge including photoreceptors 401*a* to 401*d* and contact type charging devices 402*a* to 402*d*. Use of such process cartridge facilitate the maintenance.

The image forming apparatus of the invention may further have a statically eliminating device such as an erase light irradiation device. Thus, the carry over of the residual potential of the electrophotographic photoreceptor to the next cycle can be prevented in the case of repeatedly using the electrophotographic photoreceptor, thereby further improving the image qualities.

[Process Cartridge]

A process cartridge has such a structure that for changing consumable parts of an image forming apparatus, some of the parts of the image forming apparatus are inserted in a cartridge to facilitate the change of the same. Process cartridges are commercially dealt in a state of being installed in an image forming apparatus, or singly as changeable unit or a repair unit.

Examples of the parts to be generally integrated in a process cartridge include a developing unit, a charging unit, an exposing unit and a cleaning unit. Further, a transferring unit and a fixing unit may be employed. These units can be used in any combination depending on the usability of the process cartridge and purpose of the use.

The process cartridge of the invention is characterized by including at least the electrophotographic photoreceptor and any of the above-described parts or a combination thereof and the electrophotographic photoreceptor being the electrophotographic photoreceptor according to the invention. The parts other than the electrophotographic photoreceptor, which can be inserted in the process cartridge, are not particularly restricted and publicly known parts can be employed without problem. Detailed description has been already made above in [Image forming apparatus according to the invention].

Figure 6:
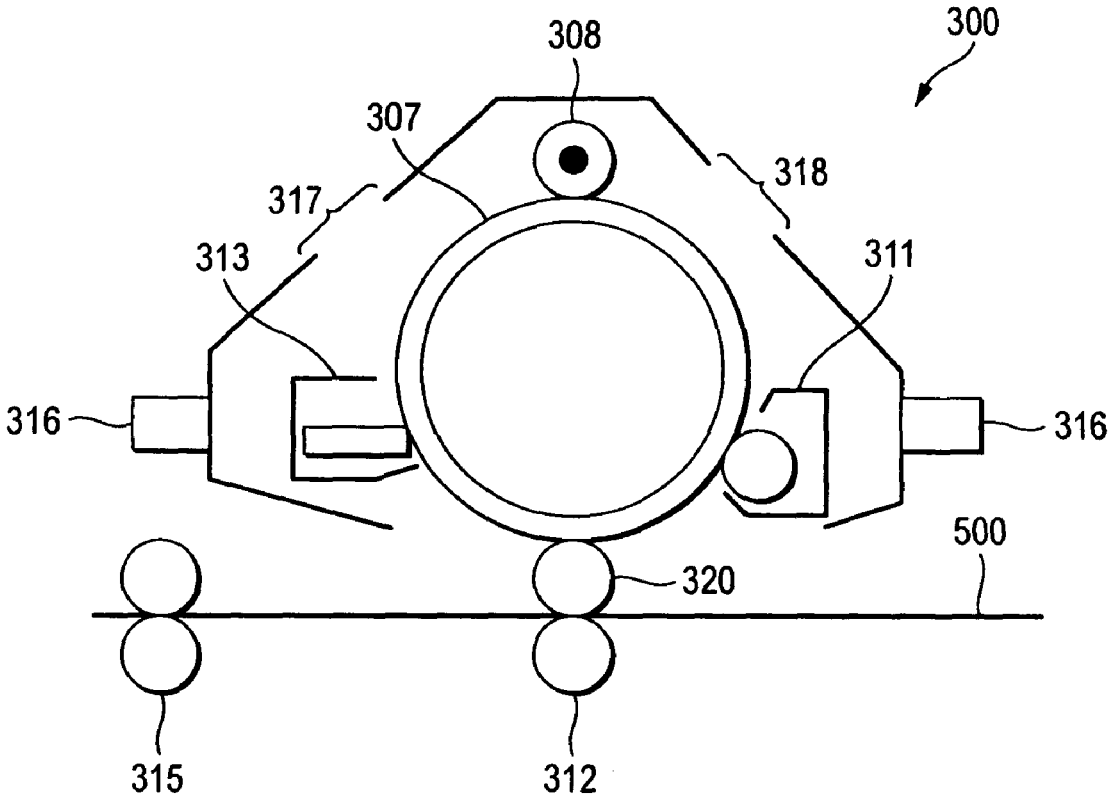
FIG. 6 is a typical sectional view schematically showing the fundamental constitution of an exemplary embodiment of the process cartridge according to an aspect of the invention.

FIG. 6 is a typical sectional view schematically showing the fundamental constitution of a preferable exemplary embodiment of the process cartridge according to the invention. In FIG. 6, a process cartridge 300 includes a photoreceptor (electrophotographic photoreceptor) 307 together with a charging device (charging unit) 308, a developing device (developing unit) 311, an intermediate transfer body 320 and a cleaning device (cleaning unit) 313. On the exterior, it further has an opening 318 for exposure and another opening 317 for antistatic exposure and, moreover, an attaching rail 316. These units are all integrated together.

In the transferring device 312 in this example, the intermediate transfer method, which includes transferring a toner image to a transfer medium 500 via the intermediate transfer body 320, is employed. The photoreceptor 307 is the electrophotographic photoreceptor according to the invention as described above.

This process cartridge 300 is detachable from the main body of the image forming apparatus including the transferring device 312, the fixing device 315 and other components that are not shown in the drawing. Thus, the process cartridge constitutes the image forming apparatus together with the main body of the image forming apparatus.

As the charging device (charging unit) 308, it is possible to select a Contact charging system with the use of, for example, a charging roller, a charging brush, a charging film or a charging tube. In this contact charging system, a voltage is applied to a conductive member being in contact with the photoreceptor surface to thereby charge the photoreceptor surface. The conductive member may have a any shape such as a brush, a blade, a pin electrode or a roller, though a roller-shaped member is particularly preferred. In usual, a roller-shaped member includes, from the outer side, a resistant layer, an elastic layer supporting the same and a core material. If necessary, a protective layer may be formed outside the resistant layer.

As the developing device 311, an arbitray known one may be appropriately selected depending on the purpose. For example, use may be made of a publicly known developing device by which development is carried out by contacting a developing agent of the monocomponent or dicomponent type with a brush, a roller or the like or in the non-contact manner. The toner to be used herein may be one prepared by mechanical milling or chemical polymerization and having various shapes from an amorphous one to a spherical one.

As the intermediate transferring device (transferring unit), not shown in the drawing, that transfers the toner image developed on the surface of the photoreceptor 307 to the intermediate transfer body 320, use can be made of a transfer charging device publicly known per se, for example, a contact charging type transferring device using a belt, a roller, a film, a rubber blade or the like, a scorotron charging type transferring device or a corotron charging type transferring device. Among them, a contact charging type transferring device is preferable because of being excellent in the charge transfer compensation ability. In addition to the above-described charging type transferring devices, it is also possible to combinedly use a peeling type transferring device.

As the cleaning device (cleaning unit) 313, use can be made of a cleaning device publicly known per se without particular restriction Examples thereof include a blade made of urethane and a cleaning brush.

Examples of the statically eliminating device (photo statically eliminating unit) not shown in the drawing include a tungsten lamp and an LED. As the light to be used in the photo statically eliminating process, use can be made of, for example, a white light from a tungsten lamp and a red light from an LED. In the photo statically eliminating process, the output is set so as to give a radiation intensity usually about several to about 30 times as large as the light quantity showing the half-exposure sensitivity of the electrophotographic photoreceptor.

In the process cartridge 300 according to the invention, the light from the photo statically eliminating device is incorporated from the opening 317 and thus the surface of the photoreceptor 307 is statically eliminated.

On the other hand, the imagewise exposure light from the exposing device (exposing unit) not shown in the drawing is incorporated from the opening 318 into the process cartridge 300 in the present example and the surface of the photoreceptor 307 is thus irradiated by it to form an electrostatic latent image.

This process cartridge according to the invention is to be mounted to the image forming apparatus as described above. Because of having the electrophotographic photoreceptor having the excellent functions and effects according to the invention mounted thereon, the process cartridge per se has long life and excellent electrical and sustaining characteristics and enables the achievement of favorable image qualities while preventing deterioration in image qualities and ghost image formation.

Although the electrophotographic photoreceptor, process cartridge and image forming apparatus according to the invention have been described above by reference to the drawings, the invention is not restricted to these constitutions. In the process cartridge and image forming apparatus according to the invention, moreover, constituting parts other than the electrophotographic photoreceptor are not particularly restricted but publicly known ones can be employed without any problems.

EXAMPLES

Next, the invention will be described in greater detail by reference to the Examples and Comparative Examples. However, it is to be understood that the invention is not restricted to these Examples.

Example 1

First, 100 parts by weight of zinc oxide (number-average particle diameter 70 nm, a trial product manufactured by Tayca Corp.) and 500 parts by weight of toluene are mixed by agitating. Then, 1.5 parts by weight of a silane coupling agent (KBM603™, manufactured by Shin-Etsu Chemical Co., Ltd.) is added thereto and the mixture is agitated for 2 hours. After distilling off toluene under reduced pressure, the residue is baked at 150° C. for 2 hours.

60 parts by weight of the thus surface-treated zinc oxide, 15 parts by weight of blocked isocyanate (Sumidule 3175™, manufactured by Sumitomo Byer Urethane Co., Ltd.) employed as a hardening agent, 15 parts by weight of a butyral resin (BM-1™, manufactured by Sekisui Chemical Co., Ltd.) and 85 parts by weight of methyl ethyl ketone are mixed together to give a liquid mixture.

38 parts by weight of the liquid mixture obtained above is mixed with 25 parts by weight of methyl ethyl ketone and dispersed in a sand mill with the use of glass beads of 1 mm in diameter for 2 hours to give a dispersion. To the obtained dispersion, 0.005 part by weight of dioctyltin dilaurate is added as a catalyst. Thus, a coating solution for forming intermediate layer is obtained.

The coating solution for forming intermediate layer is coated by the dip coating method to the outer circumferential face of an aluminum base material (diameter 30 mm, length 404 mm, thickness 1 mm, cylindrical form, ten-point-averaged surface roughness $R_{ZJIS94}$=0.3 μm) and hardened by drying at 160° C. for 100 minutes to thereby form an intermediate layer having a thickness of 15 μm.

The surface conditions of the aluminum base material (a conductive support) employed herein have been controlled to the definite state in the centerless grinding step in the course of the production thereof. The ten-point-averaged surface roughness $R_{ZJIS94}$ is measured by the same method as employed in the surface protective layer as will be described hereinafter. The same will apply to the following Examples and Comparative Examples.

Next, 15 parts by weight of hydroxygallium phthalocyanine, which shows diffraction peaks at Blag angles (2θ±0.2°) of 7.3°, 16.0°, 24.9° and 28.0° in the X-ray diffraction spectrum, 10 parts by weight of a vinyl chloride-vinyl acetate copolymer resin (VMCH™, manufactured by Nippon Unicar Co., Ltd.) employed as a binder resin and 300 parts by weight of n-butyl acetate are mixed together and dispersed in a horizontal sandmill with glass beads for 0.5 hour to thereby give a coating solution for forming charge generating layer.

The obtained coating solution for forming charge generating layer is coated by the dip coating method on the intermediate layer having been already formed and dried by heating at 100° C. for 10 minutes to thereby form a charge generating layer having a thickness of about 0.15 μm.

Next, 2 parts by weight of a compound represented by the following structural formula (A) and 3 parts by weight of a high molecular compound (viscosity average molecular weight: 39,000) represented by the following structural formula (B) are dissolved in a solvent mixture including 15 parts by weight of tetrahydrofuran and 5 parts by weight of chlorobenzene to thereby give a coating solution for forming charge transporting layer.

The obtained coating solution for forming charge transporting layer is coated by the dip coating method on the charge generating layer having been already formed and dried by a host air stream at 115° C. for 40 minutes to thereby form a charge transporting layer having a thickness of 20 μm.

(A)

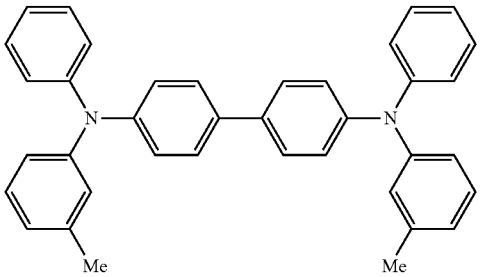

(B)

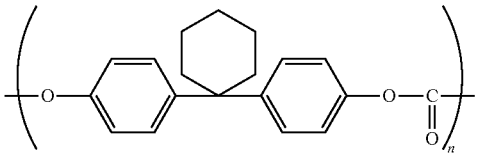

Then, 5 parts by weight of the compound (1-16) in the above table and 5 parts by weight of a resol type phenol resin (PL-4852™, manufactured by Gun Ei Chemical Industry Co., Ltd.) are dissolved in 27 parts by weight of a butyl alcohol solvent. After adding 0.2 part by weight of p-toluenesulfonic acid and 0.1 part by weight of di-n-butylamine, the mixture is mixed by agitating at 24° C. for 1 hour. Further, 0.02 part by weight of dimethyl silicone is added thereto to give a coating solution for forming surface protective layer.

The obtained coating solution for forming surface protective layer is filled in a coating device having the constitution as shown in FIG. 4 and circulated between the coating solution buffer tank 503 and the dip coating tank 521. In this state, the unfinished photoreceptor having been assembled to the charge transporting layer is coated by the dip coating method. To prevent the coating solution from entering into the pipe, the pipe is sealed with caps at both ends before dipping.

In this step, the temperature of the coating solution in the coating solution buffer tank 503 is controlled with the liquid temperature-controller 502 so that the coating solution in the dip coating tank 521 is adjusted to 24° C. Also, the temperature of the coating solution in the supplemental coating solution tank 513 is controlled to 4° C. with the liquid temperature-controller 512. The temperature in the coating chamber is 24° C.

After thus coating the coating solution for forming surface protective layer on the charge transporting layer having been already formed, the coating solution is dried by a host air stream at 120° C. for 60 minutes to thereby form a surface protective layer having a thickness of 6 μm. Thus, the electrophotographic photoreceptor of Example 1 is produced.

Example 2

The electrophotographic photoreceptor of Example 2 is produced by the same method as in Example 1 but adjusting the intermediate layer thickness in Example 1 to 19 μm.

Example 3

The electrophotographic photoreceptor of Example 3 is produced by the same method as in Example 2 but using an aluminum base material (conductive support) having an ten-point-averaged surface roughness $R_{ZJIS94}$ of 0.15 μm formed by altering the cutting bite conditions in Example 2.

Example 4

The electrophotographic photoreceptor of Example 4 is produced by the same method as in Example 1 but adjusting the charge transporting layer thickness in Example 1 to 15 μm.

Example 5

The electrophotographic photoreceptor of Example 5 is produced by the same method as in Example 1 but adjusting the charge transporting layer thickness and the surface protective layer thickness in Example 1 respectively to 25 μm and to 3 μm.

Example 6

The electrophotographic photoreceptor of Example 6 is produced by the same method as in Example 2 but adjusting the charge transporting layer thickness in Example 2 to 15 μm.

Example 7

The electrophotographic photoreceptor of Example 7 is produced by the same method as in Example 3 but adjusting the charge transporting layer thickness in Example 3 to 15 μm.

Example 8

The electrophotographic photoreceptor of Example 8 is produced by the same method as in Example 3 but adjusting the intermediate layer thickness and the surface protective layer thickness in Example 3 respectively to 23 μm and to 3 μm.

Comparative Example 1

The electrophotographic photoreceptor of Comparative Example 1 is produced by the same method as in Example 1 but adjusting the intermediate layer thickness in Example 1 to 23 μm.

Comparative Example 2

The electrophotographic photoreceptor of Comparative Example 2 is produced by the same method as in Example 3 but adjusting the intermediate layer thickness in Example 3 to 15 μm.

Comparative Example 3

The electrophotographic photoreceptor of Comparative Example 3 is produced by the same method as in Example 3 but adjusting the intermediate layer thickness and the charge transporting layer thickness in Example 3 respectively to 15 μm and to 15 μm.

Comparative Example 4

The electrophotographic photoreceptor of Comparative Example 4 is produced by the same method as in Example 3 but adjusting the intermediate layer thickness and the charge transporting layer thickness in Example 3 respectively to 23 μm and to 25 μm.

[Measurement of Surface Characteristics]

The electrophotographic photoreceptors obtained in the above Examples and Comparative Examples are subjected to the measurement of surface characteristics including the following items.

(Measurement of Ten-Point-Averaged Surface Roughness $R_{ZJIS94}$)

The ten-point-averaged surface roughness $R_{ZJIS94}$ of the completed surface protective layer is measured by using Surfcom 1400 Series manufactured by Tokyo Seimitsu K.K. The measurement is carried out in accordance with JIS B0601 (2001) (=JIS B0601 '94). Table 19 summarizes the results.

For each of the electrophotographic photoreceptors, the measurement is made at 4 positions with center angle of 90° in the peripheral direction respectively along the central axial direction and the both side peripheral directions (7 cm apart from the edge of the area to be used as a photoreceptor), namely, 12 points in total. Then, the mean is calculated and referred to as the ten-point-averaged surface roughness $R_{ZJIS94}$.

(Reflectivity of Surface Protective Layer Against Conductive Support)

The surface of the completed surface protective layer is irradiated with light of 780 nm in wavelength at the right angle to the front by using an instantaneous multi-wavelength spectrophotometer (MCPD-3000, manufactured by Otsuka Electronics). Then the normal reflected light thus rebounding is measured. Similarly, the normal reflected light reflected from the aluminum base material (conductive support) of each sample is preliminarily measured before forming the individual layers. By referring the reflectivity of the normal reflected light from the aluminum base material as to 100%, the percentage (%) of the reflectivity of the normal reflected light from the surface protective layer is calculated and referred to as "the reflectivity of the surface protective layer against the conductive support". Table 19 summarizes the results.

The measurement is made at the same 12 positions as in the measurement of the ten-point-averaged surface roughness $R_{ZJIS94}$.

[Evaluation Test]

The electrophotographic photoreceptors obtained in the above Examples and Comparative Examples are subjected to the evaluation test on the following items.

(Measurement and Evaluation of Residual Potential and Sustaining Properties)

In a low temperature and low humidity (10° C., 15% RH) environment, each electrophotographic photoreceptor is charged by using a Scorotron (grid voltage: −700 volts). One second after charging, the electrophotographic photoreceptor is irradiated at 10 mJ/m$^2$ by using a 780 nm semiconductor laser for discharge. Three seconds after discharging, the electrophotographic photoreceptor is irradiated with a red LED light at 50 mJ/m$^2$ for static elimination. The surface potential (V) of the electrophotographic photoreceptor measured at this point is referred to as the residual potential. After repeating above procedure 500,000 times, the surface potential (V) is measured and referred to as the sustaining level of the residual potential. If residential potential is 100 V or lower, result is OK (X). If residential potential is more than 100V, result is NOT OK (Y). Table 19 summarizes the results.

(Evaluation of Ghost and Interference Fringes)

Four sample rolls of each electrophotographic photoreceptor are prepared and the photoreceptors in all color of a color tandem type copy machine (DocuCentre C400 manufactured by Fuji Xerox Co., Ltd.) are replaced thereby. In a high temperature and high humidity (28° C., 85% RH) environment, ghost charts are output. In a ghost chart, a definite image pattern (a process black color composed of solid images in 4 colors (black, yellow, magenta and cyan) overlapping together) is recorded in the part corresponding to the first cycle and a half-tone image (the same colors as described above, 30% density) is recorded in the part corresponding to the second cycle. In outputting the image, the printing speed is adjusted to "moderate full color printing speed" while selecting "full color", "hand paper feeding" and "plain paper print mode".

Ghost is evaluated by observing the output print with the naked eye and referring a chart showing no ghost image as "No" and one showing a ghost image as "Yes". Interference is evaluated by observing the half-tone part with the naked eye and referring a chart showing no interference fringes as "No" and one showing interference fringes as "Yes". Table 19 summarizes the results.

The criteria for evaluation are as follows:

Interference Fringes

X: No

Y: Yes

Residual Potential (Both Initial and after 500,000 Cycles)

X: 100 V or less

Y: More than 100 V

Ghost

X: No

Y: Yes

Total Evaluation

X: all of the above evaluation results are X

Y: one or more of the above evaluation results are Y

TABLE 19

| Example or Comparative Examaple No. | Ten-point-averaged surface roughness $R_{ZJIS94}$ (μm) A: Conductive support | B: Surface protective layer | C: Reflectivity (%) | (A + B)/C × 100 | Evaluation result: Interference fringe | | Residual potential: Initial (V) | | After 500,000 cycles (V) | | Ghost | | Total evaluation |
|---|---|---|---|---|---|---|---|---|---|---|---|---|---|
| Example.1 | 0.30 | 0.20 | 9.0 | 5.6 | No | X | 53 | X | 60 | X | No | X | X |
| Example.2 | 0.30 | 0.19 | 8.5 | 5.8 | No | X | 76 | X | 70 | X | No | X | X |
| Example.3 | 0.15 | 0.20 | 9.5 | 3.7 | No | X | 60 | X | 70 | X | No | X | X |
| Example.4 | 0.30 | 0.23 | 9.3 | 5.7 | No | X | 65 | X | 70 | X | No | X | X |
| Example.5 | 0.30 | 0.18 | 8.9 | 5.4 | No | X | 52 | X | 65 | X | No | X | X |
| Example.6 | 0.30 | 0.22 | 8.7 | 6.0 | No | X | 60 | X | 75 | X | No | X | X |
| Example.7 | 0.15 | 0.22 | 9.6 | 3.9 | No | X | 65 | X | 80 | X | No | X | X |

TABLE 19-continued

| Example or Comparative Examaple No. | Ten-point-averaged surface roughness $R_{ZJIS94}$ (μm) A: Conductive support | B: Surface protective layer | C: Reflectivity (%) | (A + B)/C × 100 | Evaluation result: Interference fringe | | Residual potential: Initial (V) | | After 500,000 cycles (V) | | Ghost | | Total evaluation |
|---|---|---|---|---|---|---|---|---|---|---|---|---|---|
| Example.8 | 0.15 | 0.21 | 9.0 | 4.0 | No | X | 50 | X | 85 | X | No | X | X |
| Comparative Example 1 | 0.30 | 0.19 | 8.0 | 6.1 | No | X | 63 | X | 150 | Y | Yes | Y | Y |
| Comparative Example 2 | 0.15 | 0.20 | 10.0 | 3.5 | Yes | Y | 44 | X | 55 | X | No | X | Y |
| Comparative Example 3 | 0.15 | 0.21 | 10.3 | 3.5 | Yes | Y | 65 | X | 70 | X | No | X | Y |
| Comparative Example 4 | 0.15 | 0.17 | 9.1 | 3.5 | Yes | Y | 45 | X | 65 | X | Yes | Y | Y |

<Discussion on the Results>

As the results given in the above Table 19 clearly indicate, each of the electrophotographic photoreceptors of Examples, which has the appropriately controlled planar conditions as specified by the invention, is free from the occurrence of a ghost image or interference fringes and has excellent potential characteristics and sustaining properties both at the initial stage and after the durability test. In contrast thereto, the electrophotographic photoreceptors of Comparative Examples are insufficient in either of the items of interference fringes, ghost and residual potential.

What is claimed is:

1. An electrophotographic photoreceptor comprising:

a conductive support;

a photosensitive layer; and a surface protective layer as an outermost layer of the electrophotographic photoreceptor, wherein the electrophotographic photoreceptor satsfies following formulas (a) and (b):

$$3.6 \leqq (A+B)/C \times 100 \leqq 6 \quad (a)$$

$$B \leqq 0.3, \quad (b)$$

wherein

A (μm) represents a ten-point-averaged surface roughness $R_{ZJIS94}$ of the conductive support, B (μm) represents a ten-point-averaged surface roughness $R_{ZJIS94}$ of the surface protective layer, and C (%) represents a reflectivity of the surface protective layer against the conductive support.

2. The electrophotographic photoreceptor according to claim 1, futher comprising:

an intermediate layer between the conductive support and the photosensitive layer.

3. The electrophotographic photoreceptor according to claim 2, wherein the intermediate layer comprises particles dispersed therein.

4. The electrophotographic photoreceptor according to claim 3, wherein the particles are conductive particles.

5. The electrophotographic photoreceptor according to claim 4, wherein the conductive particles are made of zinc oxide.

6. The electrophotographic photoreceptor according to claim 1, wherein the surface protecitve layer comprises:

a phenol resin; and a charge transporting substance having a reactive functional group.

7. The electrophotographic photoreceptor according to claim 6, wherein the surface protective layer futher comprises:

a leveling agent.

8. The electrophotographic photoreceptor according to claim 1, wherein the photosensitive layer comprises:

a charge generating layer; and a charge transporting layer.

9. An electrophotographic process cartridge which is detachable from an image forming apparatus, the electrophotographic process cartridge comprising:

the electrophotographic photoreceptor according to claim 1; and at least one unit selected from the group consisting of a charging unit, an exposing unit, a developing unit, a transferring unit, a fixing unit and a cleaning unit.

10. An image forming apparatus comprising:

an electrophotographic photoreceptor according to claim 1;

a charging unit that charges a surface of the electrophotographic photoreceptor;

an exposing unit that imagewise exposes the charged surface of the electrophotographic photoreceptor to form an electrostatic latent image;

a developing unit that feeds a toner to the surface of the electrophotographic photoreceptor and thus develops the electrostatic latent image to form a toner image; and a transferring unit that transfers the developed toner image to a target.

11. The electrophotographic photoreceptor according to claim 1, wherein C(%) represents a reflectivity of the surface protective layer against the conductive support, and falls within a range of $8.5 \leqq C \leqq 9.6$.

* * * * *